US012741190B2

(12) United States Patent
Yoo

(10) Patent No.: US 12,741,190 B2
(45) Date of Patent: Sep. 22, 2026

(54) METHOD OF PROVIDING EXERCISE VIDEO GUIDE AND APPARATUS THEREOF

(71) Applicant: DRAX INC., Anyang-si (KR)

(72) Inventor: Seon Kyung Yoo, Seoul (KR)

(73) Assignee: DRAX INC., Anyang-si (KR)

( * ) Notice: Subject to any disclaimer, the term of this patent is extended or adjusted under 35 U.S.C. 154(b) by 738 days.

(21) Appl. No.: 18/146,607

(22) Filed: Dec. 27, 2022

(65) Prior Publication Data

US 2023/0201696 A1 Jun. 29, 2023

(30) Foreign Application Priority Data

Dec. 28, 2021 (KR) ..... 10-2021-0190358
May 9, 2022 (KR) ..... 10-2022-0056881

(51) Int. Cl.
*A63B 71/06* (2006.01)

(52) U.S. Cl.
CPC .. *A63B 71/0622* (2013.01); *A63B 2071/0636* (2013.01)

(58) Field of Classification Search
None
See application file for complete search history.

(56) References Cited

U.S. PATENT DOCUMENTS 5,342,054 A * 8/1994 Chang ..... A63B 24/0021 434/252
5,836,770 A * 11/1998 Powers ..... A63B 69/00 434/257
5,949,951 A * 9/1999 Sklar ..... A63B 71/0622
6,330,665 B1 * 12/2001 Wise ..... G06F 12/0207 711/E12.003
6,468,086 B1 * 10/2002 Brady-Koontz ..... G09B 5/02 434/257
6,971,972 B1 * 12/2005 McGovern ..... G11B 27/034 482/3
9,440,113 B2 * 9/2016 Roman ..... A63B 24/0075
10,079,977 B2 * 9/2018 Cho ..... H04M 1/725
10,524,591 B2 1/2020 Kim
10,811,055 B1 * 10/2020 Kimber ..... G11B 27/005
11,681,426 B2 * 6/2023 Lee ..... H04N 19/48 715/720

(Continued)

FOREIGN PATENT DOCUMENTS

EP 3 846 150 A1 7/2021
JP 2014-155190 A 8/2014

(Continued)

OTHER PUBLICATIONS

Extended European Search Report issued May 23, 2023, in Application No. 22216575.5.

(Continued)

*Primary Examiner* — Paul A D'Agostino
(74) *Attorney, Agent, or Firm* — Sughrue Mion, PLLC

(57) ABSTRACT

Provided is a method of providing an exercise video guide and a device thereof. The method of providing an exercise video guide includes: receiving times of two or more set movements; and generating a video including set movements corresponding to the times based on a reverse-replay of a section of an original video comprising one set movement.

9 Claims, 21 Drawing Sheets

(56) References Cited

U.S. PATENT DOCUMENTS

2001/0043194 A1* 11/2001 Amron ..... G06F 1/1626 345/169
2004/0013406 A1* 1/2004 Barton ..... H04N 21/4341
2004/0204919 A1* 10/2004 Li ..... G11B 27/28
2009/0047644 A1* 2/2009 Mensah ..... G09B 5/06 434/247
2009/0075782 A1* 3/2009 Joubert ..... H03G 3/32 482/9
2010/0205228 A1* 8/2010 Reese ..... G06Q 30/02 707/805
2012/0288140 A1* 11/2012 Hauptmann ..... G06T 7/292 382/103
2013/0123667 A1* 5/2013 Komatireddy ..... A61B 5/746 600/595
2013/0189662 A1* 7/2013 Gilbert ..... A63B 71/0622 434/247
2013/0286047 A1* 10/2013 Katano ..... G02B 27/0101 348/333.01
2013/0294752 A1* 11/2013 Merchawi ..... G11B 27/034 386/290
2014/0013344 A1* 1/2014 Taxier ..... H04N 21/8456 725/9
2014/0205980 A1* 7/2014 Braier ..... G09B 5/02 434/247
2014/0270711 A1* 9/2014 Maser ..... G11B 27/034 386/290
2014/0280219 A1* 9/2014 Maser ..... G11B 27/034 707/748
2015/0220523 A1* 8/2015 Lagree ..... G06F 16/951 707/752
2015/0375117 A1* 12/2015 Thompson ..... A63F 13/79 463/9
2016/0163224 A1* 6/2016 Rauhala ..... G09B 19/003 434/257
2017/0001073 A1* 1/2017 Krueger ..... A63B 24/0062
2017/0259121 A1* 9/2017 King ..... A63B 24/0075
2017/0357848 A1* 12/2017 Su ..... G06F 3/017
2018/0036591 A1* 2/2018 King ..... H04N 5/76
2018/0130373 A1* 5/2018 Bernard-Paroly ..... G06F 3/017
2018/0300851 A1* 10/2018 Elor ..... G06V 40/176
2019/0076741 A1* 3/2019 Thompson ..... A63F 13/35
2019/0240539 A1* 8/2019 Perlman ..... A63B 24/0075
2019/0262664 A1* 8/2019 Schindler ..... A63B 24/0075
2019/0388724 A1* 12/2019 Polinsky ..... A63B 24/0087
2020/0296317 A1* 9/2020 Post, Jr. ..... H04N 7/0122
2021/0197026 A1* 7/2021 Kerslake ..... G09B 19/003
2021/0204030 A1* 7/2021 Wu ..... H04N 21/42224
2021/0279554 A1* 9/2021 Ibtehaz ..... G16H 20/30
2023/0206513 A1* 6/2023 Pyles ..... G09G 3/3406 345/592

FOREIGN PATENT DOCUMENTS

KR 10-2015-0081750 A 7/2015
KR 10-2017-0138110 A 12/2017
KR 10-2020-0125527 A 11/2020
WO WO-2022025877 A1 * 2/2022 ..... G06F 18/24147

OTHER PUBLICATIONS

Communication dated Oct. 28, 2023, issued in Korean Application No. 10-2022-0056881.

* cited by examiner

METHOD OF PROVIDING EXERCISE VIDEO GUIDE AND APPARATUS THEREOF

CROSS-REFERENCE TO RELATED APPLICATIONS

This application is based on and claims priority under 35 U.S.C. § 119 to Korean Patent Application Nos. 10-2021-0190358, filed on Dec. 28, 2021, and 10-2022-0056881, filed on May 9, 2022, in the Korean Intellectual Property Office, the disclosures of which are incorporated by reference herein in their entireties.

BACKGROUND

1. Field

The present disclosure relates to a method of providing an exercise video guide and an apparatus thereof.

2. Description of the Related Art

In recent years, as work and life balance, which is a state in which there is a balance between work and personal life, has attracted attention, consumption for one's life, such as exercising, after work, on weekends, or in spare time, is increasing. As one of the work and life balance, a user's desire to manage one's health is increasing, and in order to improve the quality of life with some investment of time, the number of users engaging in swimming, fitness, personal training (PT), golf, pilates, etc. is increasing.

As the number of users who exercise increases, the desire to exercise in a correct position is increasing, and videos to guide exercise are being provided. The exercise video guide are videos of instructors or trainers performing aerobic movements, yoga movements, and fitness. The user may exercise according to the movement of the instructors etc. demonstrated in the exercise video guide.

However, the exercise video guide guides only in the time-level and do not selectively guide each user.

SUMMARY

The present disclosure provides a method of providing an exercise video guide for each level of a user and an apparatus thereof.

The present disclosure provides a method of providing an exercise video guide based on reverse playing and an apparatus thereof.

The present disclosure provides a method of providing an exercise video guide based on a movement of a user and an apparatus thereof.

Additional aspects will be set forth in part in the description which follows and, in part, will be apparent from the description, or may be learned by practice of the presented embodiments of the disclosure.

According to an aspect of the disclosure, a method of providing an exercise video guide including a set movement as a repetition movement: receiving a number of sets for a set movement repeated two or more times; and generating a video including set movements corresponding to the times based on reverse-replay of a section of an original video including one set movement.

The original video may include a first section showing a first movement, and a second section showing a second movement opposite to the first movement.

The generating of the video may include: a first step of reverse-replaying the first section after replaying the first section; and a second step of replaying the second section after reverse-replaying the second section.

At least one of the first step and the second step may be repeatedly performed correspondingly to the times of set movements.

A sum of a repetition times of the first step and the second step may be less than the times of set movements.

The sum of the repetition times of the first step and the second step may be one time less than the times of set movements.

The method may further include a third step of sequentially replaying the first section and the second section.

The original video may further include: a third section showing a preparation movement; and a fourth section showing a finishing movement.

The method may further include displaying the generated video.

The generated video may be displayed on a mirror display.

According to an aspect of the disclosure, a device for providing an exercise video guide including a set movement as a repetition movement includes: a user interface configured to receive a number of sets for a set movement repeated two or more times; a memory storing an original video including one set movement; and a processor configured to read out the original video from the memory and generate a video including set movements corresponding to the times based on the reverse-replay of a section of the original video.

The original video may include: a first section showing a first movement; and a second section showing a second movement opposite to the first movement.

The processor may be further configured to execute: a first step of reverse-replaying the first section after replaying the first section; and a second step of replaying the second section after reverse-replaying the second section.

The processor may repeatedly execute at least one of the first step and the second step correspondingly to the times of set movements.

The processor may repeatedly execute at least one of the first step and the second step less than the times of set movements.

The device may further include a device displaying the generated video.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

Figure 1:
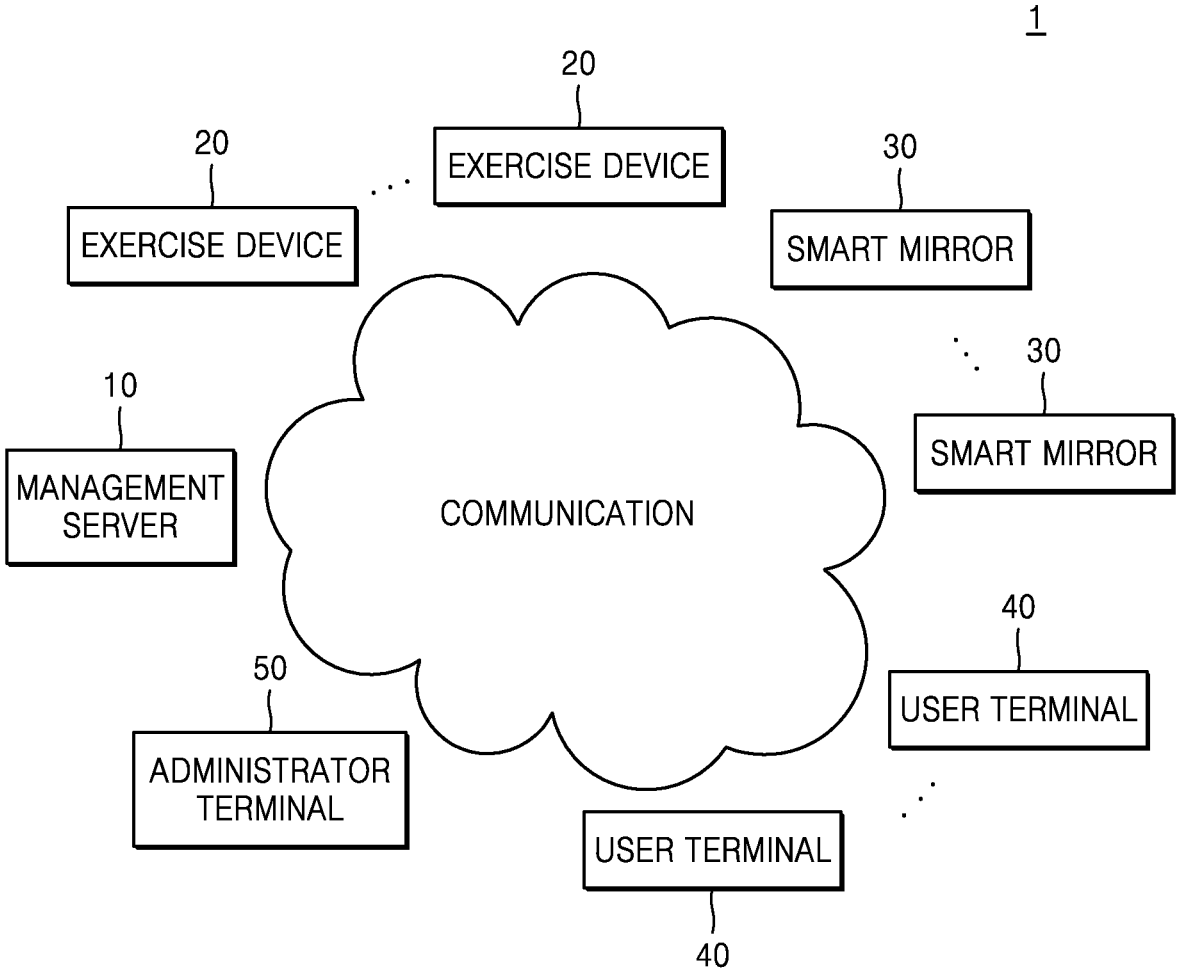
FIG. 1 is a schematic view of an exercise device management system according to an embodiment.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

With respect to the terms used to describe in the present disclosure, the general terms which are currently and widely used are selected in consideration of functions of structural elements in the various embodiments of the present disclosure. However, meanings of the terms can be changed according to intention, a judicial precedence, the appearance of a new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

The terms such as the first, the second, etc. may be used to explain various components, but the components should not be limited by the terms. The terms are used only to distinguish one component from another.

FIG. 1 is a schematic view of an exercise device management system 1 according to an embodiment. Referring to FIG. 1, the system 1 may include a management server 10 connected by a network, an exercise device 20, a mirror display 30, a user terminal 40, and an administrator terminal 50. In addition, the system 1 may further include a payment server and a content server linked to the management server 10.

The network may be implemented as various wired/wireless networks such as a local area network (LAN), a wide area network (WAN), a value added network (VAN), a personal area network (PAN), a mobile radio communication network, or a satellite network.

The management server 10 may be connected with the exercise device 20, the mirror display 30, the user terminal 40, and the administrator terminal 50 through the network to transmit and receive data, store an exercise schedule, exercise list, etc. of the user in response to the request of the administrator terminal 50, store an exercise result of the user from information received from the user terminal 40 or the exercise device 20, and provide the exercise result to the administrator terminal 50 or the user terminal 40 according to the request of the administrator terminal 50 or the user terminal 40.

In addition, the management server 10 may control the exercise device 20 in a fitness center according to the request of the user terminal 40, or generate calorie information corresponding to the exercise history and exercise result by using the exercise result received from the exercise device 20.

The management server 10 may be an operating server of an internet site. The management server 10 may operate a dedicated application (App) and/or web program connected to the exercise device 20, the mirror display 30, the user terminal 40, and the administrator terminal 50, or may support the operation. In addition, the management server 10 may support an interface that is necessary for building an application such as an application programming interface (API) on a web or app so that an application for implementing a content platform may operate in a digital information display.

The exercise device 20 may include an exercise body that is implemented as a weight training device or a treadmill and moves according to the user's movement. In addition, the exercise device 20 may provide an exercise guide to the user under the control of the management server 10, and may transmit the exercise result of the user to the management server 10. The exercise device 20 may be set in various modes under the operation of the user or the control of the management server 10.

The user terminal 40, which is a terminal registered on the management server 10 to receive an exercise management service, may access the management server 10, an access terminal, and the exercise device 20 through a wired or wireless network to transmit and receive data. The user terminal 40 may be a smartphone, a personal computer (PC), a tablet PC, a notebook computer, a smart TV, a mobile phone, a personal digital assistant (PDA), a laptop, a media player, a global positioning system (GPS) device, an e-book terminal, a digital broadcasting terminal, navigation, a digital camera, a wearable device, and other mobile and non-mobile computing devices and smart bands, but is not limited thereto. Here, the user terminal 40 may mean any terminal that a registered user may log into by accessing the management server 10, as well as a terminal owned by the user who receives the exercise management service.

The administrator terminal 50, which is a terminal registered on the management server 10 to provide an exercise management service, may access the management server 10 through a wired or wireless network to transmit and receive data. The administrator terminal 50 may be a smartphone, a PC, a tablet PC, a notebook computer, a smart TV, a mobile phone, a PDA, a laptop, a media player, a GPS device, an e-book terminal, a digital broadcasting terminal, navigation, a digital camera, a wearable device, and other mobile or non-mobile computing devices, but is not limited thereto. Here, the administrator terminal 50 may mean any terminal that a registered administrator may log into by accessing the management server 10, as well as a terminal owned by one who is registered as the administrator in the management server 10.

Figure 2:
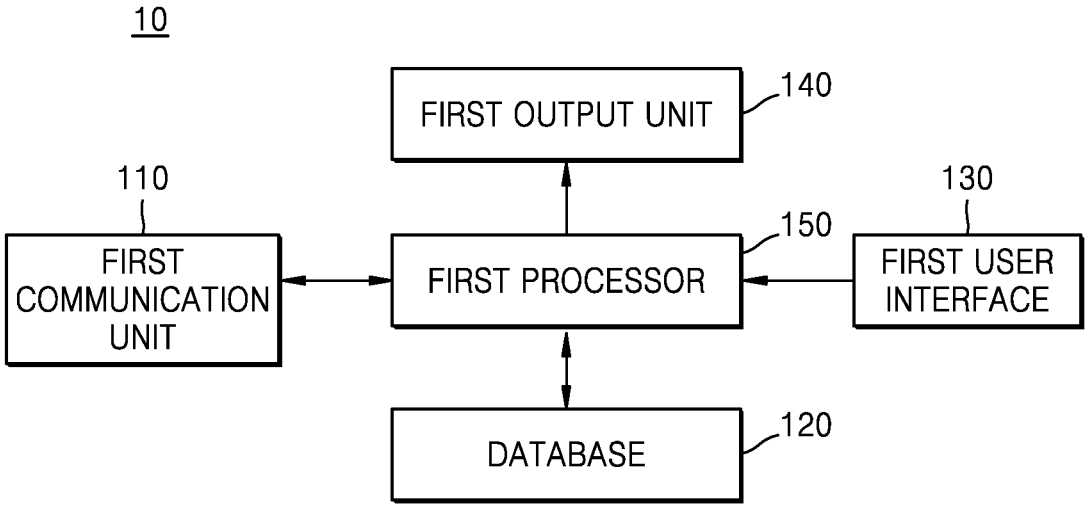
FIG. 2 is a block diagram of a management server according to an embodiment.

FIG. 2 is a block diagram of the management server 10 according to an embodiment. Referring to FIG. 2, the management server 10 may include: a first communication unit 110 to communicate, through a network, with an external device, for example, an access terminal, an exercise device 20, a mirror display 30, a user terminal 40, an administrator terminal 50, etc.; a database 120 in which information about the user's exercise program, the user's exercise history, the entry and exit list of the fitness center, the mode of the exercise device 20, etc. are stored; a first user interface 130 into which a user command of the administrator etc. that manages the management server 10 is input; a first output unit 140 displaying or notifying a state of the fitness center; and a first processor 150 to perform general functions of the management server 10. The first processor 150 may generate an exercise program of the user according to the request of the administrator terminal 50, or manage the state of use of the center and set the mode of the exercise device 20.

Although not shown in the drawing, the access terminal 20, the administrator terminal 50, and the user terminal 40 may include the communication unit, the storage unit, the user interface, the processor, etc.

Figure 3:
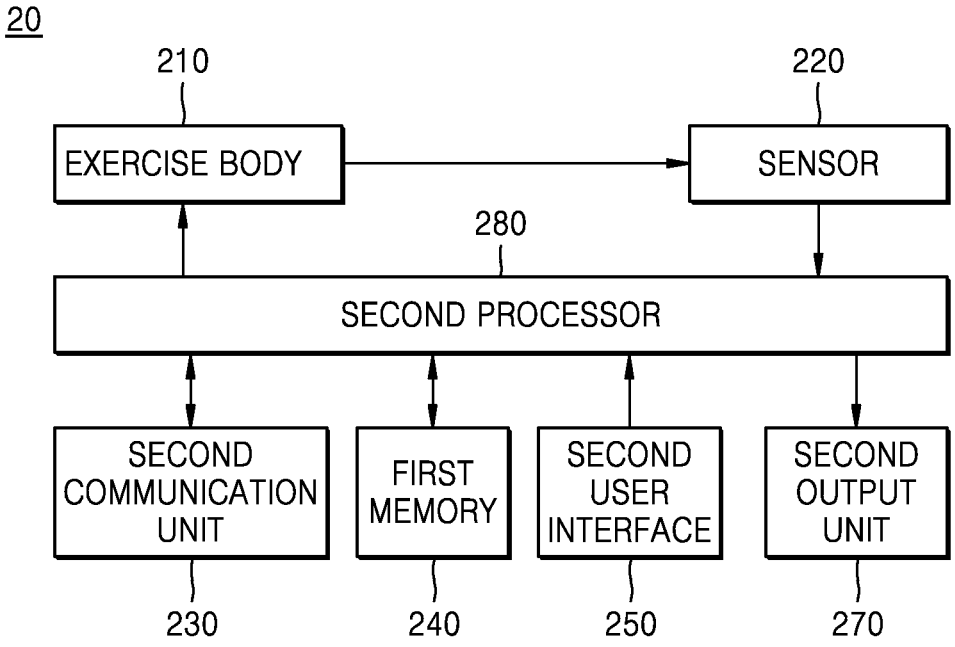
FIG. 3 is a block diagram of an exercise device according to an embodiment.

FIG. 3 is a block diagram of the exercise device 20 according to an embodiment. The exercise device 20 according to an embodiment may be an aerobic exercise device or an anaerobic exercise device. For example, the exercise device 20 may be an aerobic exercise device such as a treadmill, a bicycle, an elliptical, a stepper, etc. or an anaerobic exercise device such as chest press, shoulder press, arm curl lat pulldown pec deck fly, seated row, low pull chinning dipping, leg curl, leg extension, leg press, inner thigh, outer thigh, total hip, torso back extension, abdominal machines, etc.

The exercise device 20 may include an exercise body 210, a sensor 220, a second communication unit 230, a first memory 240, the second user interface 250, a second output unit 270, and a second processor 280.

The exercise body 210 is a physical exercise device that moves according to the user's movement. The exercise body 210 according to an embodiment may add, reduce or maintain load according to a set exercise level. The exercise body 210 may vary depending on the type of exercise device 20.

The sensor 220 may detect the movement of components included in the exercise body 210 and transmit a result thereof to the second processor 280. The sensor 220 may include a laser sensor, a motion sensor, a gyro sensor, etc.

The second communication unit 230 may communicate with an external device, for example, the management server 10, the access terminal, another exercise device 20, the user terminal 40, the administrator terminal 50, etc. The second communication unit 230 may perform communication with the management server 10 through various wired/wireless networks such as the LAN, the WAN, the VAN, the PAN, the mobile radio communication network, or the satellite communication network. In addition, the second communication unit 230 may perform communication with the access terminal, the user terminal 40, and the administrator terminal 50 through local area networks or, the PAN, etc. Accordingly, the exercise device 20 may be prevented from being controlled by external devices other than the management server 10. However, embodiments are not limited thereto. In some cases, the second communication unit 230 may perform far-field communication with the administrator terminal 50.

The first memory 240 may store various information used by at least one component (e.g., the second processor 280 or the sensor 220) included in the exercise device 20. The information may include, for example, software (e.g., a program), and input data or output data regarding commands related to the software. The first memory 240 may include a volatile memory or a nonvolatile memory. As an example, the first memory 240 may include an adjustment motion range or a critical motion range determined in advance according to the user information.

The second user interface 250 may receive command or data to be used in the exercise device 20 from the outside (e.g., the user) of the exercise device 20. The second user interface 250 may include, for example, a microphone, a mouse, a keyboard, an electronic tag, or a digital pen (e.g., a stylus pen). As an example, the user may input user information through the second user interface 250. For example, the user information may include one or more of the user's name, age, gender, height, weight, and exercise career.

The second output unit 270 may provide output information. The output information according to an embodiment may be information that guides the user information, the user exercise information, or the exercise of the user. As an example, the second output unit 270 may include a display for displaying output information. In addition, the second output unit 270 may be physically or electrically connected to the exercise body 210. For example, the display may be installed on the frame structure of the exercise body 210. However, the present disclosure is not limited thereto, and even if a display is arranged to be apart from the exercise body 210, the display comprises a communication unit and may be connected to the exercise body 210 through the communication unit.

The second processor 280 may control the exercise device 20 in general and control the second communication unit 230 to communicate with the external device. The second processor 280 may, for example, control at least one other component (e.g., a hardware or software component) connected to the second processor 280 by executing software (e.g. a program), and may process or operate various data. According to an embodiment, as at least part of the processing or operating of data, the second processor 280 may load a command or data received from another component (e.g., the third communication unit 230 or the third user interface) into a volatile memory of the first memory 240, process the command or data stored in the volatile memory, and store result data in a nonvolatile memory of the first memory 240.

Figure 4:
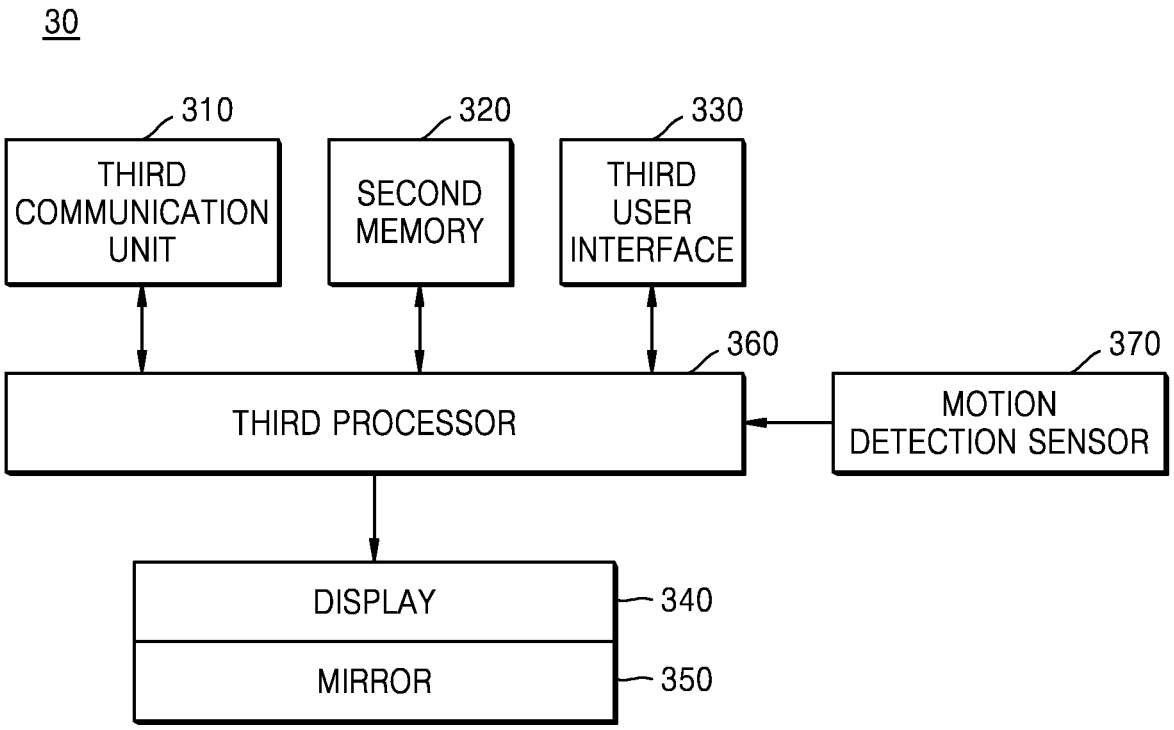
FIG. 4 is a block diagram of a mirror display according to an embodiment.

FIG. 4 is a block diagram of the mirror display 30 according to an embodiment. The mirror display 30 is a device that may provide one or more of a mirror function and a display function according to the user's needs. A film (not shown) including polarizing functions may further be provided on the display, and thus, the display may be understood to include a known device that may simultaneously perform a role of a display and a mirror by reflecting certain light (e.g., light corresponding to the user's posture) and transmitting certain light (e.g., light corresponding to an image output from the display).

The mirror display 30 may include a third communication unit 310, a second memory 320, a third user interface 330, a display 340, a mirror 350, and a third processor 360.

The third communication unit 310 may communicate with an external device, for example, the management server 10, the user terminal 40, the administrator terminal 50, etc. The third communication unit 310 may perform communication with the management server 10 through various wired/wireless networks such as the LAN, the WAN, the VAN, the PAN, the mobile radio communication network, or the satellite communication network. In addition, the third communication unit 310 may communicate with the user terminal 40 and the administrator terminal 50 through local area networks or, the PAN, etc. Accordingly, the mirror display 30 may be prevented from being controlled by external devices other than the management server 10. However, embodiments are not limited thereto. In some cases, the third communication unit 310 may perform far-field communication with the administrator terminal 50.

The second memory 320 may store various information used by at least one component (e.g., the third processor 360) included in the mirror display 30. The information may include, for example, software (e.g., a program), and input data or output data regarding commands related to the software. The second memory 320 may include a volatile memory or a nonvolatile memory. As an example, the second memory 320 may already store by an original video that may be used to create an exercise video guide.

The third user interface 330 may receive input of various user commands. As an example, the third user interface 330 may receive a user command for replaying the exercise video guide, which the mirror display 30 may display. The user may input the exercise event and the times of sets through the third user interface 330 to replay the exercise video guide.

The display may display the exercise video guide under the control of the third processor 360. The display may be implemented as a liquid crystal display (LCD), organic light emitting diodes (OLED), etc., and may further include a touch screen to function as the third user interface 330.

In addition, the mirror 350 may be arranged in at least some area of the front surface of the display. The mirror 350 may include a film, for example, a polarizing film that reflects light incident from the outside and transmits light incident from the display.

The third processor 360 may control the mirror display 30 in general and control the third communication unit 310 to communicate with the external device. The third processor 360 may, for example, control at least one other component (e.g., hardware or software components) connected to the third processor 360 by executing software (e.g. a program), and may process or operate various data. According to an embodiment, as at least part of data processing or operation, the third processor 360 may load a command or data received from another component (e.g., the third communication unit 230 or the third user interface) into a volatile memory of the second memory 320, process the command or data stored in the volatile second memory, and store result data in a nonvolatile memory of the second memory 320. For example, the third processor 360 may store an original video including one operation set received from the server, etc. in the second memory.

The original video may be separated into multiple sections. Specifically, the original video may be separated into a preparation section R showing a preparation movement, a finishing section E showing a finishing movement, and a set section S that may be a repeated movement. For example, if the original video is a video that includes a squat exercise, which is an example of a set movement, the original video may be separated into a preparation section R showing a movement of preparing for a squat exercise, a finishing section E showing a movement of finishing the squat exercise, and a set section S wherein squat movements may be repeated, that is, the set section S showing movements of sitting and standing.

The set section S may be divided into two sub sections based on an inflection point, for example, the point in which the direction of the operation is converted. When the set section S is a section that shows the squat movement, based on the sitting point of the squat movement, the set section S may be separated into a first section showing a sitting movement and a second section showing a standing movement. When the first section showing the sitting movement is a forward section F, because the standing movement is performed in a backward of the sitting movement, the second section showing the standing movement may be a backward section B.

The third processor 360 may receive the original video separated into a plurality of sections from the outside, for example, from the server, and store the received original video. However, embodiments are not limited thereto. The third processor 360 may separate the received original video into a plurality of sections as described above and store the separated sections. Alternatively, after storing the original video, the third processor 360 may generate the exercise video guide after separating the original video into a plurality of sections when the third processor receives a request to replay the exercise video guide from a user command, etc.

The mirror display 30 may further include a motion detection sensor 370. A motion detection sensor 370, which is an equipment for obtaining the user's movement, may include a vision camera, a vision sensor, an acceleration sensor, a gyro sensor, a geomagnetic sensor, an infrared sensor, etc.

The motion detection sensor 370 may extract an area corresponding to the user's joint from detected data to obtain coordinate data and speed data of the corresponding joints.

Although the motion detection sensor is described as a component of the mirror display, embodiments are not limited thereto. The motion detection sensor may be a separate device. Alternatively, the camera of the user terminal 40 may perform the function of the motion detection sensor.

Figure 5:
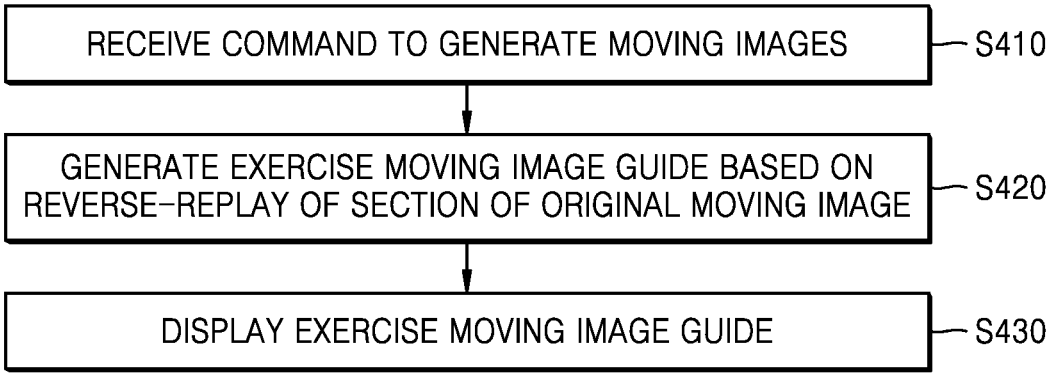
FIG. 5 is a flowchart illustrating a method of providing an exercise video guide according to an embodiment.

FIG. 5 is a flowchart illustrating a method of providing the exercise video guide according to an embodiment.

The third processor 360 may receive a command to generate the exercise video guide, the command including the times of set movements, from the third communication unit 310 or the third user interface 330 S410. When the user enters a certain distance from the mirror display 30, the mirror display 30 may change from a standby mode to an operation mode. In addition, the mirror display 30 may request an exercise event to be replayed to the user terminal 40, which is carried by the user. By transmitting the pre-stored exercise event and the times of set movements of the exercise event to the mirror display 30, the user terminal 40 may request the replay of the exercise video guide regarding the corresponding exercise event. Alternatively, the user may input the command to replay the exercise video guide by inputting the exercise event and the times of set movements through the user interface of the mirror display 30.

The third processor 360 may generate the exercise video guide including the corresponding times of set movements based on the reverse-replay of a section of the original video. The third processor 360 may generate a video corresponding to the set movement by replaying and reverse-replaying a section of the original video. As the operation of replaying and reverse-replaying a section increases, the times of set movements included in the generated video may also increase. Details of the method of generating an exercise video guide will be described later.

The third processor 360 may display the generated exercise video guide on the display 340 S430. The third processor 360 may display the exercise video guide on the display after completing the generation of the exercise video guide, or may display the exercise video guide simultaneously with the generation of the exercise video guide. Generating and displaying the exercise video guide may be called as replaying the exercise video guide.

Figure 6:
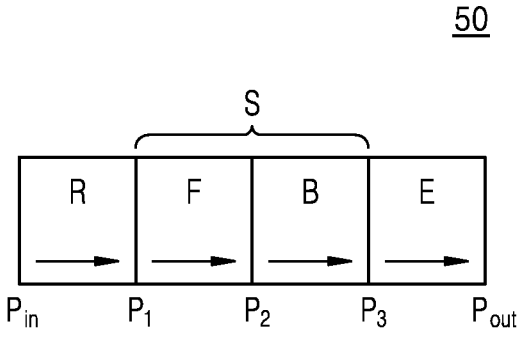
FIG. 6 is a diagram illustrating an original video including one set movement according to an embodiment.

FIG. 6 is a diagram illustrating an original video including one set movement according to an embodiment. Referring to FIG. 6, the original video 50 may be separated into a plurality of different sections. The original video 50 may be separated into a preparation section R showing a preparation movement, a finishing section E showing a finishing movement, and a set section S that may be a movement of a repetition movement.

The set section S may be separated into a forward section F and a backward section B based on the inflection point of the movement, that is, the point in which the direction of the movement changes. For example, the set section S showing the movement of sitting down and standing up in the squat exercise may be separated into the forward section F showing the sitting movement from the starting point of the set section S to a sitting point and the backward section B showing the standing movement from the sitting point to the finishing point of the set section S. The movement included in the forward section F may be opposite to the movement included in the backward section B. For example, while the movement included in the forward video is sitting down, the movement included in the backward video may be standing up.

The time during which the forward section F is replayed and the time during which the backward section B is replayed may be the same, but is not limited thereto. For example, the time during which the forward section F is replayed and the time during which the backward section B is replayed may be within a 10% error range.

A pose in the video at the starting point of the set section S and a pose in the video at the finishing point of the set section S may be the same. However, embodiments are not limited thereto. For example, the pose at the starting point of the set section S and the pose at the finishing point of the set section S may be within a 10% error range.

The original video 50 may be pre-stored in the second memory 320 of the mirror display 30.

The third processor 360 may generate the exercise video guide 50*a* including a plurality of repeating movements, that is, a plurality of set movements.

Figure 7:
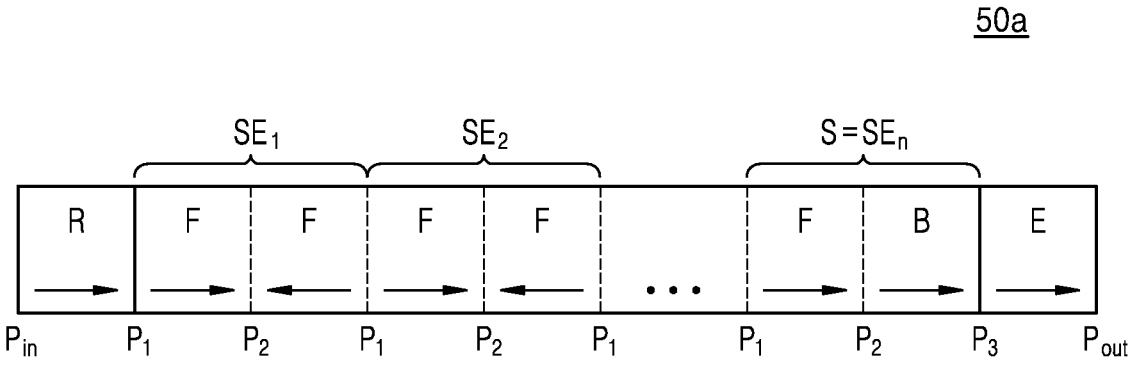
FIG. 7 is a reference diagram illustrating a method of generating an exercise video guide including a plurality of set movements according to an embodiment.

FIG. 7 is a reference diagram illustrating a method of generating an exercise video guide 50 including a plurality of set movements according to an embodiment.

When the third processor 360 receives a command to replay the exercise video guide including n set movements from the third user interface 330 or the external device, the third processor 360 may read out the original video 50 corresponding to the exercise video guide from the second memory 320. The third processor 360 may receive the original video 50 from the external device, for example, the management server 10, the user terminal 40, etc., and use the original video 50 after temporarily storing the original video 50 in the second memory 320.

The original video 50 may include a plurality of sections R, F, B, E as described in FIG. 6, and the plurality of sections R, F, B, and E may be separated by a marker. However, embodiments are not limited thereto. If the original video 50 is not separated into a plurality of sections R, F, B, E, the third processor 360 may separate the original video 50 into a plurality of sections using markers, etc. as described in FIG. 6.

The third processor 360 may generate the exercise video guide 50*a* including n set movements based on the reverse-replay of a section of the original video.

As shown in FIG. 7, the third processor 360 may replay the preparation section R of the original video 50.

The third processor 360 may reverse-replay a section of the set section S when replaying the set section S. Specifically, because the forward section F includes the sitting movement, when the forward section F is reverse-replayed, a standing movement may be included. If the third processor 360 reverse-replays the forward section F in an inflection point $P_2$ after replaying the forward section F, first set section $S_1$ of sitting down and standing up may be generated. If the third processor 360 reverse-replays the forward section F n−1 times after replaying the forward section F, n−1 set sections $SE_1$, $SE_2$, . . . may be generated.

In addition, if the third processor 360 sequentially replays the forward section F and the backward section B, an nth set section $SE_n$ may be generated. Finally, the third processor 360 may complete the generation of the exercise video guide 50*a* by replaying the finishing section E.

Figure 8:
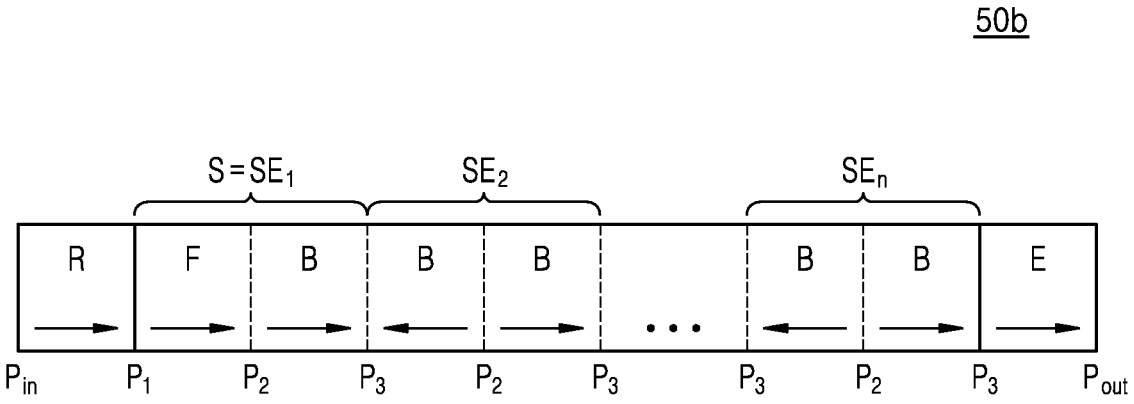
FIG. 8 is a reference diagram illustrating a method of generating an exercise video guide including a plurality of set movements according to another embodiment.

FIG. 8 is a reference diagram illustrating a method of generating an exercise video guide including a plurality of set movements according to another embodiment.

When the third processor 360 receives a request to replay the exercise video guide including n set movements from the third user interface 330 or the external device, the third processor 360 may generate the exercise video guide including n set movements based on the reverse-replay of a section of the original video 50.

As shown in FIG. 8, the third processor 360 may replay the preparation section R of the original video 50.

As the third processor 360 replays the forward section F and the backward section B, a first set section $SE_1$ may be generated.

In addition, as the third processor 360 reverse-replays the backward section B and then replays the backward section B, a second set section $SE_2$ may be generated. For example, if the backward section B of the video includes the standing movement, the video including the sitting movement by reverse-replay of the backward section B may be replayed.

If the third processor 360 replays the backward section B n−1 times after reverse-replaying the backward section B, n−1 set sections $SE_2$, . . . , $SE_n$ may be generated.

The third processor 360 may complete the generation of the exercise video guide 50*b* by replaying the finishing section E.

As described above, because the exercise video guides 50*a* and 50*b* including a plurality of set movements may be replayed based on the reverse-replay of a section of the original video 50 including one set movement, an exercise video guide without interruption in the video may be generated. Because the original video showing one set movement is used, even if the set movement is repeated, a video in which the movements are not loosened may be provided. If an exercise video guide including a plurality of set movements is captured, a person who repeats the set movement, for example, the trainer, may change one's posture as one repeats the set movement. However, because the times of set movements may increase by repeatedly replaying and reverse-replaying a section of the original video, the loosening of the posture may be prevented.

In addition, because there is no need to produce and store the original video by the times of set movements, the cost of producing the original video may be reduced, and the storage capacity of the original video may be reduced.

A plurality of set movements may be implemented by repeatedly replaying the set section of the original video 50 showing one set movement.

Figure 9:
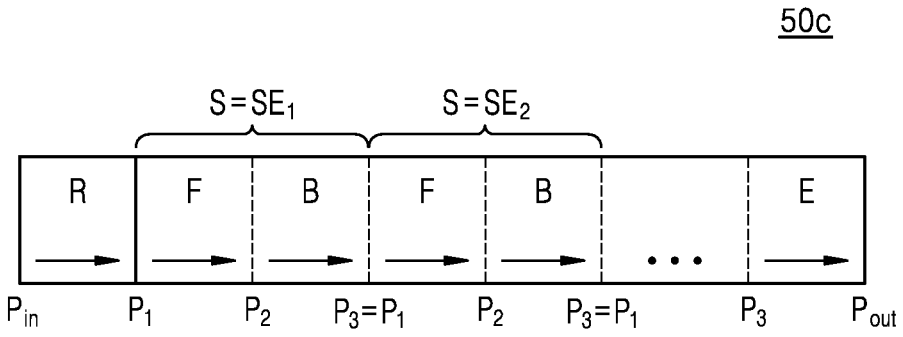
FIG. 9 is a reference diagram illustrating, as a comparative example, a method of providing a video including a plurality of set movements.

FIG. 9 is a reference diagram illustrating a method of providing a video including a plurality of set movements.

Referring to FIG. 9, the third processor 360 may replay the set section $SE_1$ after replaying the preparation section R of the original video 50. The third processor 360 may repeatedly replay the set section S n times. That is, when the third processor 360 reaches the finishing point $P_3$ of the set section $S=SE_1$ after repeatedly replaying the set section $S=SE_1$, the third processor 360 may move to the starting point $P_1$ of the set section S and replay the set section $S=SE_2$ again.

Because repetitive replay is made by moving from the finishing point $P_3$ of the set section S to the starting point $P_1$ of the set section S, even for a short period of time, a phenomenon in which the video is disconnected may occur. In addition, if the pose in the video in the finishing point $P_3$ of the set section S is different from the pose in the video in the starting point $P_1$ of the set section S, the discontinuity of the video may be further aggravated.

As the original video 50 is obtained by capturing a person's exercise process, the pose of the finishing point $P_3$ of the set section S may not be completely identical to the pose of the starting point $P_1$ of the set section S. Thus, a phenomenon in which the exercise video guide 50*c* generated through repetitive replay is disconnected may be inevitable. The phenomenon of disconnection may reduce the immersion of the user in the exercise.

According to an embodiment, when the exercise video guides 50*a* and 50*b* including the plurality of set movements are generated using the reverse-replay of a section of the original video 50, the starting point of the set movement may be identical to the finishing point of the set movement, and thus, the phenomenon of disconnection may not occur. Thus, the immersion of the user in the exercise may be improved while the user views the video.

The original video 50 of FIG. 6 includes one set movement. However, embodiments are not limited thereto. The original video may include two or more set movements. In general, a repetition movement may include a plurality of set movements. Thus, the original video may include a default times of set movements, and the third processor 360 may generate an exercise video guide including set movements exceeding the default times of set movements based on the reverse-replay of a section of the original video.

Figure 10:
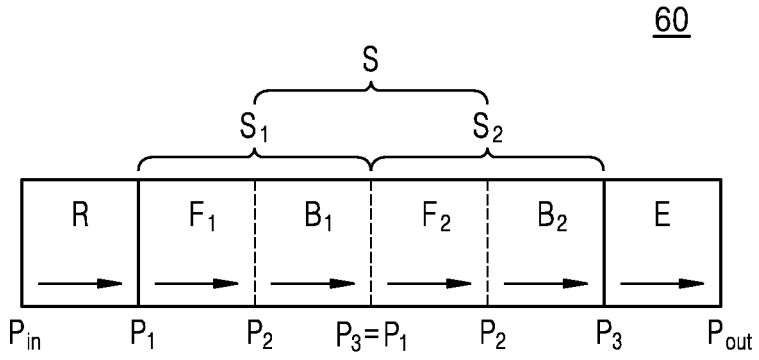
FIG. 10 is a diagram illustrating an original video including a plurality of set movements according to an embodiment.

FIG. 10 is a diagram illustrating an original video 60 including a plurality of set movements according to an embodiment. As shown in FIG. 10, the original video 60 may include two set movements as a default. For example, the set section S of the original video 60 may include a first set section $S_1$ and the second set section $S_2$, both including the same type of set movement.

In case an exercise video guide including more set movements than the default times of set movements is to be generated, the third processor 360 may increase the times of set movements by repeating the replay and reverse-replay of a section of the set section S.

Figure 11:
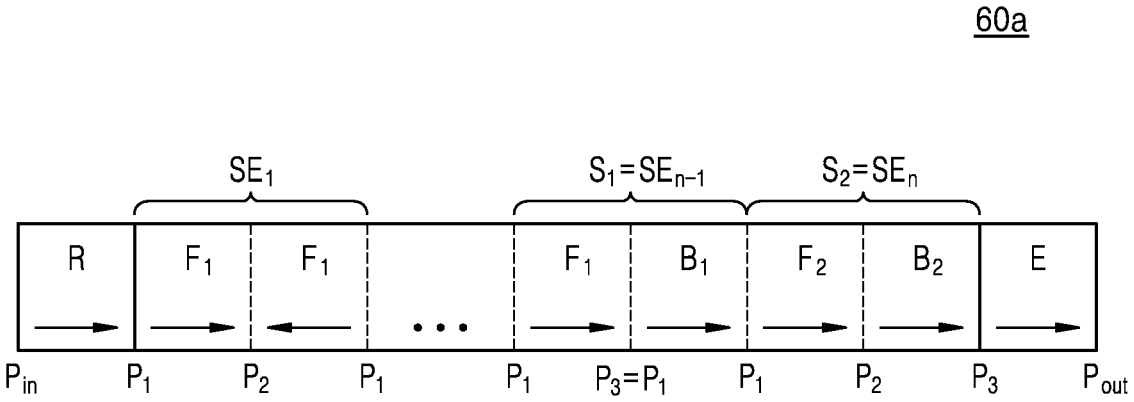
FIG. 11 is a reference diagram illustrating a method of providing an exercise video guide by using one set section among a plurality of set sections according to an embodiment.

FIG. 11 is a reference diagram illustrating a method of providing an exercise video guide by using one set section among a plurality of set sections according to an embodiment.

As shown in FIG. 11, for example, the third processor 360 may generate a first set section $SE_1$ by replaying and reverse-replaying the forward section $F_1$ of the first set section $S_1$ of the set section S. The third processor 360 may generate n−2 set sections by replaying and reverse-replaying the forward section $F_1$ of the first set section $S_1$ of the set section S n−2 times.

In addition, the third processor 360 may generate the n−1th set section $SEn_{-1}$ and the nth set section $SE_n$ by replaying the first set section $S_1$ and the second set section $S_2$ of the original video 60.

In FIG. 11, the set section was increased by replaying and reverse-replaying the forward section $F_1$ of the first set section $S_1$, but embodiments are not limited thereto. The set section may be increased by replaying and reverse-replaying the backward section $B_1$ of the first set section $S_1$. Alternatively, the times of set movements may be increased by using replay and reverse-replay of a forward section $F_2$ or a backward section $B_2$ of the second set section $S_2$.

Alternatively, the third processor 360 may increase the set movement by replaying and reverse-replaying a section of the first set section $S_1$ and a section of the second set section $S_2$.

Figure 12:
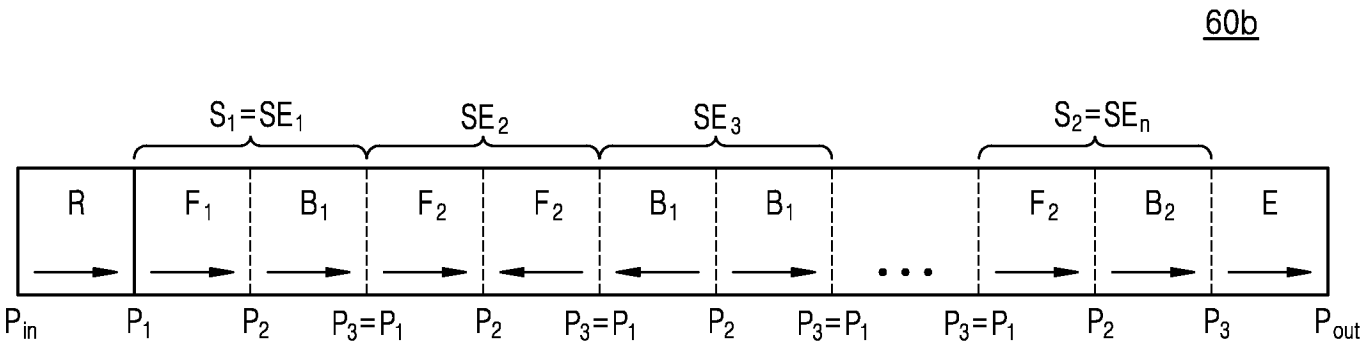
FIG. 12 is a reference diagram illustrating a method of providing an exercise video guide by using a plurality of set sections, according to an embodiment.

FIG. 12 is a reference diagram illustrating a method of providing an exercise video guide 60*b* by using a plurality of set sections according to an embodiment. The third processor 360 may increase the set section by replaying and reverse-replaying a section of the first set section $S_1$ and a section of the second set section $S_2$.

As shown in FIG. 12, the third processor 360 may generate the first set section $SE_1$ by replaying the forward section $F_1$ and the backward section $B_1$ of the first set section $S_1$ of the original video 60.

The third processor 360 may generate a second set section $SE_2$ by replaying and reverse-replaying the forward section $F_2$ of the second set section $S_2$, and the processor 360 may generate a third set section $SE_3$ by replaying and reverse-replaying the backward section $B_2$ of the first set section $S_1$. The processor may generate an n−1th set section in the fourth set section by repeatedly replaying and reverse-replaying the forward section $F_2$ of the second set section $S_2$ and reverse-replaying and replaying the backward section $B_1$ of the first set section $S_1$.

The third processor 360 may generate an nth set section $SE_n$ by sequentially replaying the forward section $F_2$ and the backward section $B_2$ of the second set section $S_2$.

The reverse-replaying number of times or the reverse-replaying section may be diversified because the exercise video guides 60*a* and 60*b* are generated by using the original video 60 including the default times of set movements.

The original video includes one type of set movement. However, embodiments are not limited thereto. The original video may include a plurality of different types of set movements. For example, the original video may include a first type set movement through which repetition movement may be performed in the right direction, and a second type set movement through which repetition movement may be performed in the left direction. The third processor 360 may provide the exercise video guide by using reverse-replay of a section of the original video.

Figure 13:
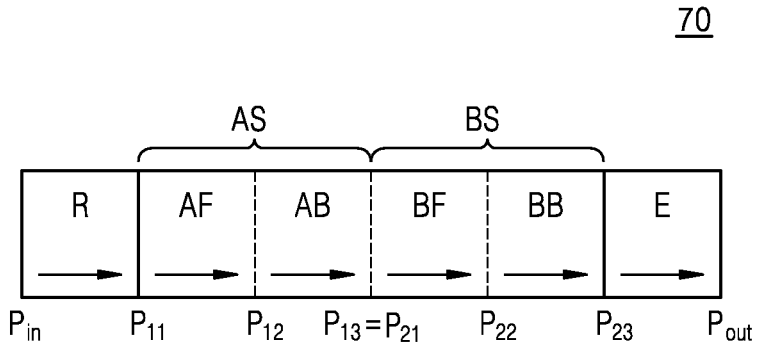
FIG. 13 is a diagram illustrating an original video including a plurality of different types of set movements, according to an embodiment.

FIG. 13 is a diagram illustrating an original video 70 including a plurality of different types of set movements according to an embodiment. Referring to FIG. 13, the original video 70 may be separated into a plurality of sections R, S, and E. The original video 70 may be separated into a preparation section R showing a preparation movement, a finishing section E showing a finishing movement, and a set section S that may be a movement of a repetition movement.

The set section S may be separated into a plurality of set sections AS and BS based on a point where the type of repetition movement is changed. For example, the set section S may be separated into a first type set section AS and a second type set section BS based on a point $P_{13}=P_{21}$ where the type of the repetition movement is changed. For example, a lunge exercise may be separated into a right lunge exercise, that is, a first type set section AS in which the right leg is put back, and a left lunge exercise, that is, a second type set section BS in which the left leg is put back.

Each of the set sections AS and BS may be separated into the forward section AF and BF and the backward section AB and BB based on the point in which the direction of the operation is changed. For example, the right lunge exercise and the left lunge exercise may be separated into the forward section showing the sitting movement and the backward section showing the standing movement.

For example, the set section S of the lunge exercise may be separated into the forward section AF of the first type set section AS showing movements from the starting point of the set movement $P_1$ to the point where the right knee is bent to 90 degrees and the upper body is lowered $P_{12}$, a backward section AB of the first type set section AS showing movements from the point where the right knee is bent to 90 degrees and the upper body is lowered $P_{12}$ to the point where both knees are spread and the upper body is raised $P_{13}=P_{21}$, the forward section BF of the second type set section BS showing movements from the point where both knees are spread and the upper body is raised $P_{13}=P_{21}$ to the point where the left knee is bent to 90 degrees and the upper body is lowered $P_{22}$, and the backward section BB of the second type set section BS showing movements from the point where the left knee is bent to 90 degrees and the upper body is lowered $P_{22}$ to the point where both knees are spread and the upper body is raised $P_{23}$.

The time when the forward section of each type of the set section is replayed and the time when the backward section of the corresponding type of the set section is replayed may be the same. However, for example, the time when the forward section is replayed and the time when the backward section is replayed may be within a 10% error range.

The pose in the video at the starting point of each type of the set section and the pose in the video at the end of the corresponding type of the set section may be the same. However, embodiments are not limited thereto. For example, the pose at the starting point of each type of the set section and the pose at the finishing point of the corresponding type of the set section may be within a 10% error range.

The third processor 360 may generate the exercise video guide including the plurality of set movements by using the original video 70 of FIG. 13.

Figure 14:
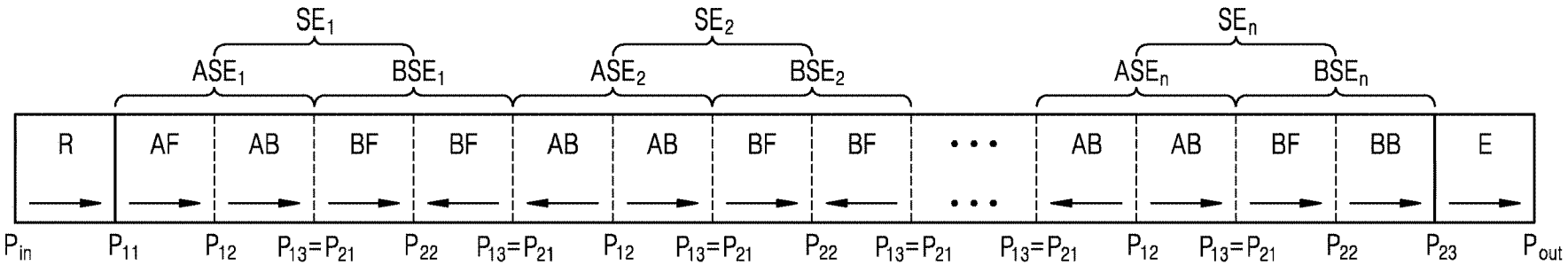
FIG. 14 is a reference diagram illustrating a method of generating an exercise video guide including a repetition movement, according to an embodiment.

FIG. 14 is a reference diagram illustrating a method of generating an exercise video guide 70*a* including a repetition movement according to an embodiment.

If n times of set movement is requested from the third user interface 330 or the external device, the third processor 360 may generate the exercise video guide 70*a* including n set movements based on the reverse-replaying of a section of the original video 70.

As shown in FIG. 14, the third processor 360 may replay the preparation section R of the original video 70.

The third processor 360 may sequentially replay the forward section AF of the first type set section AS, the backward section AB of the first type set section AS, and the forward section BF of the second type set section BS, and reverse-replaying the forward section BF of the second type set section BS, thereby generating first set sections $ASE_1$ and $BSE_1$.

If the original video includes a lunge exercise, when the third processor 360 replays the forward section AF of the first type set section AS and the backward section AB of the first type set section AS, the video of the right side lunge exercise may be generated. In addition, if the third processor 360 replayss the forward section BF of the second type set section BS and then reverse-replays the forward section BF of the second type set section BS, the third processor 360 may generate the left side lunge exercise. That is, because the forward section BF of the second type set section BS is a video in which the upper body is lowered as the left knee is bent, when reverse-replayed, the forward section BF of the second type set section BS may be a video in which the upper body is raised as the left knee is stretched.

The third processor 360 may reverse-replay the backward section AB of the first type set section AS, sequentially replay the backward section AB of the first type set section AS and the forward section BF of the second type set section BS, and then reverse-replay the forward section BF of the second type set section BS, thereby generating second set sections $ASE_2$ and $BSE_2$.

The third processor 360 may reverse-replay the backward section AB of the first type set section AS, sequentially replay the backward section AB of the first type set section AS and the forward section BF of the second type set section BS, and then reverse-replay the forward section BF of the second type set section BS n−2 times, thereby generating n−2 set sections.

In addition, the third processor 360 may reverse-replay the backward section AB of the first type set section AS, and sequentially replay the backward section AB of the first type set section AS, the forward section BF of the second type set section BS, and the backward section BB of the second type set section BS, thereby generating nth set sections $ASE_n$ and $BSE_n$. Finally, the third processor 360 may complete the generation of the exercise video guide 70*a* by replaying the finishing section E.

FIG. 14 describes a method of alternately replaying the first type set section AS and the second type set section BS, but is not limited thereto. The third processor 360 may generate n times of the first type set section by using a first type set section AS, and may generate n second type set sections by using the second type set section BS.

Figure 15:
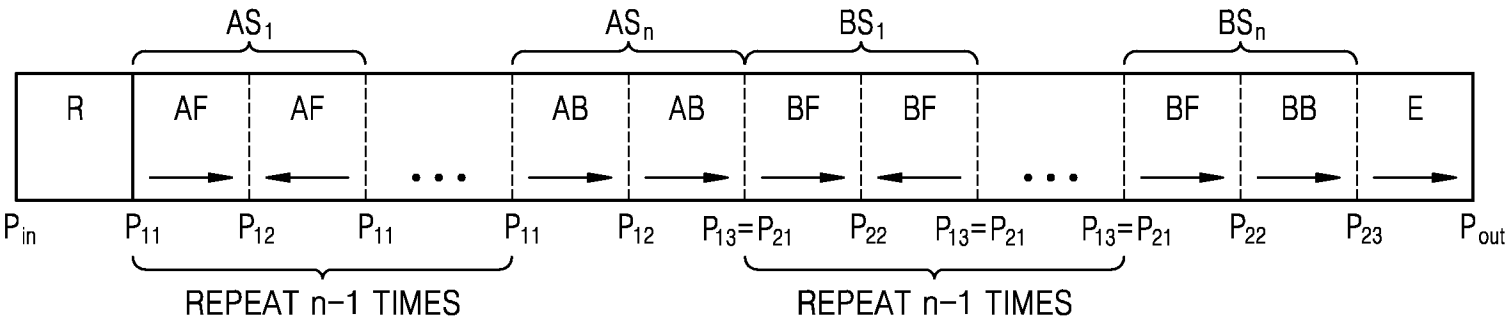
FIG. 15 is a reference diagram illustrating a method of generating an exercise video guide including a repetition movement, according to another embodiment.

FIG. 15 is a reference diagram illustrating a method of generating an exercise video guide 70*b* including a repetition movement according to another embodiment.

If n times of set movement is requested from the third user interface 330 or the external device, the third processor 360 may replay the exercise video guide 70*b* including n set movements based on the reverse-replaying of a section of the original video 70.

As shown in FIG. 15, the third processor 360 may replay the preparation section R of the original video 70.

The third processor 360 may perform n−1 times of replaying the forward section AF of the first type set section AS and then reverse-replaying the forward section AF of the first type set section AS, thereby generating n−1 first type set sections $AS_1$, . . . . In addition, the third processor 360 may sequentially generate the forward section AF of the first type set section AS and the backward section AB of the first type set section AS, thereby generating an nth first type set section $AS_n$.

In addition, the third processor 360 may perform n−1 times of replaying the forward section BF of the second type set section BS and then reverse-replaying the forward section BF of the second type set section BS, thereby generating n−1 second type set sections $BS_1$, . . . . In addition, the third processor 360 may sequentially replay the forward section BF of the second type set section BS and the backward section BB of the second type set section BS, thereby generating an nth second type set section $BS_n$.

Finally, the third processor 360 may complete the generation of the exercise video guide 70*b* by replaying the finishing section E.

In FIG. 15, repeatedly replaying each type set section n times is based on the reverse-replay of FIG. 7, but is not limited thereto. The reverse-replay of FIG. 8 may be applied to the reverse-replay of the type set section. Alternatively, the reverse-replay of FIG. 7 and the reverse-replay of FIG. 8 may be combined and applied.

FIGS. 14 and 15 illustrated a method of providing the exercise video guide by using the original video including two different types of set movements. However, embodiments of the disclosure are not limited thereto. The exercise video guide may also be provided using an original video including three or more different types of set movements. In addition, the exercise video guide may be generated by using not only an original video including one default set of different types of repetition movements, but also an original video including two default sets of different types of repetition movements.

The generated exercise video guide may be provided on the mirror display 30 or on another device.

The exercise video guide according to an embodiment may be adjusted or terminated in correspondence to the movement of the user.

Figure 16:
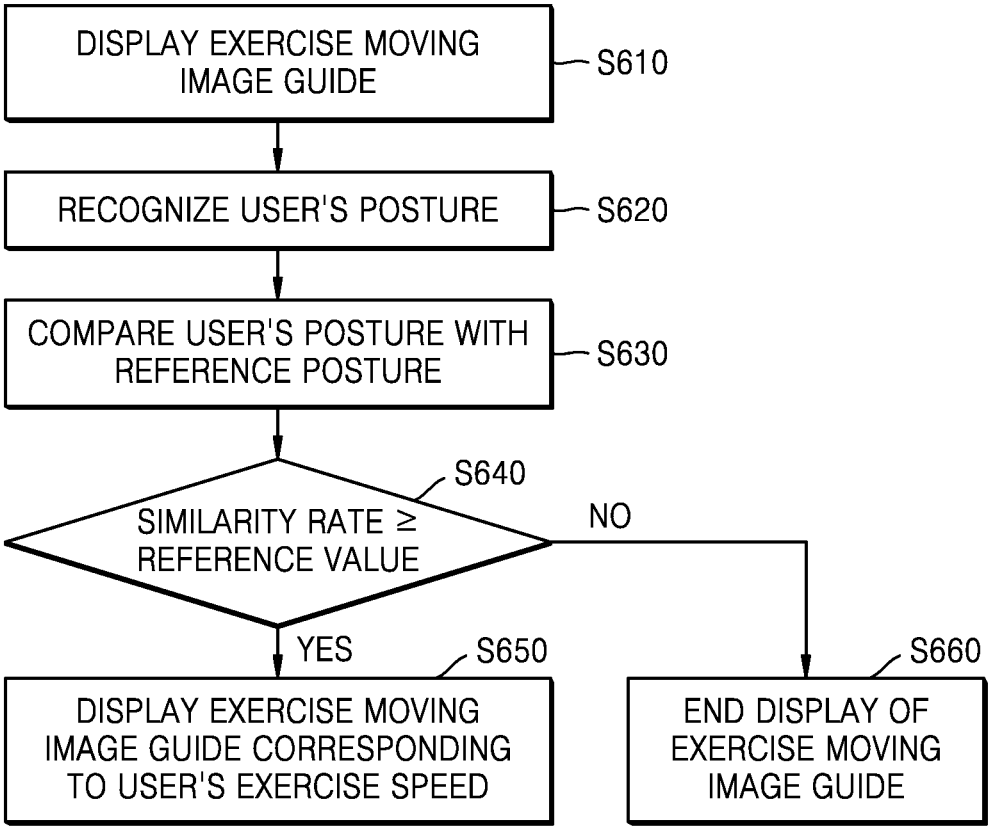
FIG. 16 is a flowchart illustrating a method of providing an exercise video guide based on a movement of a user, according to an embodiment.

FIG. 16 is a flowchart illustrating a method of providing an exercise video guide based on the movement of the user according to an embodiment. Referring to FIG. 16, the third processor 360 may display the exercise video guide on the display 340 S610. When the user enters a certain distance from the mirror display 30, the third processor 360 may control the mirror display 30 to change from a standby mode to an operation mode. In addition, the mirror display 30 may request the exercise event to be replayed to the user terminal 40 that is carried by the user. By transmitting the pre-stored exercise event and the times of set movements of the exercise event to the mirror display 30, the user terminal 40 may request the replay of the exercise video guide regarding the corresponding exercise event.

Alternatively, the user may input the command to display the exercise video guide by inputting the exercise event and the times of set movements through the third user interface 330 of the mirror display 30.

As described above, the third processor 360 may generate the exercise video guide including a plurality of set movements based on the reverse-replay of a section of the original video, and display the generated exercise video guide on the display 340. However, embodiments are not limited thereto. The second memory 320 may pre-store the exercise video guide for each user or each set. The third processor 360 may read out the pre-stored exercise video guide corresponding to the user or the set according to the replay request command, and display the corresponding exercise video guide on the display 340.

The third processor 360 may recognize the user's posture S620. The motion detection sensor 370 may detect the user's movement and deliver the result to the third processor 360. The motion detection sensor 370, which is an equipment for obtaining the user's movement, may include a vision camera, a vision sensor, an acceleration sensor, a gyro sensor, a geomagnetic sensor, an infrared sensor, etc. The third processor 360 may recognize the user's posture by using movement data received from the motion detection sensor 370.

For example, when the movement data is image data including the user, the third processor 360 may extract keypoints for recognizing the posture in the image data including the user. The keypoints may be areas indicating a human body. For example, the keypoint may be the shoulders, shoulder joints, upper arms, elbow joints, lower arms, wrist joints, hands, torso, hip joints, upper legs, knee joints, lower legs, ankle joints, feet, etc. The third processor 360 may recognize the user's posture by analyzing the keypoints, the connection angle (three-dimensional angle) between the keypoints, and the distance (three-dimensional distance) between the keypoints.

For example, the third processor 360 may recognize two-dimensional posture in the movement data by using deep learning methods, fast human pose estimation (FPD), etc. Alternatively, the third processor 360 may recognize a three-dimensional posture by using a model-based method using a 3D body model or a model-free method of estimating without a 3D model. However, embodiments are not limited thereto. Human posture recognition technology may be applied in various known methods.

The third processor 360 may recognize the position (hereinafter referred to as "reference posture") of the target (e.g., the trainer) included in the exercise video guide in a similar way as recognizing the user's posture. However, embodiments are not limited thereto. The third processor 360 may estimate the reference posture from the original video to generate a movement modeling, and pre-store the original video and the movement modeling together. In addition, when displaying the exercise video guide based on the original video, the third processor 360 may extract the reference posture while modifying the movement modeling matched with the displayed exercise video guide. Movement modeling may be performed by the third processor 360, but may also be performed by external devices such as servers.

Alternatively, if the motion detection sensor 370 is a vision camera which captures the user's posture and the target's posture displayed on the screen of the display 340, the third processor 360 may recognize the user's posture and reference posture by extracting the user's posture and reference posture from the detected image data.

The third processor 360 may compare the user's posture with the reference posture corresponding to the user's posture included in the exercise video guide S630. The third processor 360 may calculate a similarity rate between the user's posture and the reference posture included in the exercise video guide and corresponding to the user's posture at a certain point in time, for example, at present time.

The user's posture recognized at a certain point in time and the reference posture displayed on the display 340 may be different. For example, if the user's exercise speed is less than the replaying speed of the exercise video guide, the user's posture may fall behind the reference posture displayed on the display 340. That is, the reference posture corresponding to the user's posture included in the exercise video guide is pre-displayed. The third processor 360 may compare the recognized user's posture with the pre-displayed reference posture corresponding to the user's posture.

Alternatively, if the user's exercise speed is greater than the replaying speed of the exercise video guide, the user's posture may move ahead of the reference posture displayed on the display 340. That is, the reference posture corresponding to the user's posture included in the exercise video guide may not yet be displayed. The third processor 360 may only compare the recognized user's posture with the reference posture corresponding to the user's posture when the reference posture corresponding to the user's posture is displayed on the display 340.

A higher similarity rate may indicate a higher match rate between the user's posture and the reference posture. The third processor 360 may use the similarity rate based on the angle or distance of the keypoints. The third processor 360 may calculate the similarity rate for each angle of the keypoints or distance of the keypoints, and may quantitatively calculate the similarity rate by weighting and summing the similarity rate. The similarity rate of all keypoints may be calculated, but the similarity rate of some keypoints that are important in the reference posture may be calculated. Various known methods may be applied to the method of similarity rate calculation. Thus, the details of the similarity rate calculation method are omitted.

If the similarity between the user's posture and the reference posture is equal to or greater than a reference value S640—yes, the third processor 360 may display the exercise video guide on the display 340 in correspondence to the user's exercise speed S650.

The replay speed of the exercise video guide may be determined based on the original video. Alternatively, the replay speed of the exercise video guide may be adjusted according to the user's command etc. However, because the replay speed is fixed regardless of the user's exercise speed, the replay speed of the exercise video guide and the user's exercise speed may be different.

If the user is an elderly person, not in a good condition, or a beginner, the user's exercise speed may be less than the replay speed of the exercise video guide. If the user exercises in accordance with the replay speed of the exercise video guide, the user may get hurt or may not be able to exercise in the right posture. Because the user may slow down as the times of set movements increases while the replay speed of the exercise video guide is constant, the user may get hurt or may not be able to exercise in the right posture.

The third processor 360 according to an embodiment may adjust the replay speed of the exercise video guide in correspondence to the user's exercise speed.

If the user's posture is determined to be a reference section ahead of the reference position corresponding to the user's posture, the third processor 360 may determine that the user's exercise speed is greater than the replay speed of the exercise video guide. Here, the reference section may be a time section corresponding to the sub set movement of the set movement or the set movement. For example, in the case of the squat exercise, each of the forward section and the backward section are times sections that correspond to the sub set movement, and a sum of the forward section and the backward section may be a time section corresponding to the set movement. The reference section may be pre-set by the user or administrator differently for each exercise event.

The third processor 360 may specify the currently recognized user's posture based on the previously recognized user's posture. For example, the third processor 360 may determine whether the currently recognized user's posture is a posture forward section of the squat exercise or a posture of the backward section of the squat exercise based on the previously recognized user's posture. Similarly, the third processor 360 may determine the current reference posture based on the previous reference posture.

The third processor 360 may increase the replay speed of the exercise video guide so that the displayed reference posture corresponds to the recognized user's posture. The replay speed may be adjusted in proportion to the user's movement speed, or may be adjusted step by step. For example, the third processor 360 may adjust the replay speed of the exercise video guide to any one of 1.1 times, 1.2 times, 1.5 times, or 2 times the original speed so that the displayed reference posture corresponds with the user's posture, that is, the reference posture displayed at a certain point in time becomes identical to the user's posture.

If the user's posture is determined to be a reference section behind the displayed reference position, the third processor 360 may determine that the user's exercise speed is less than the replay speed of the exercise video guide. Thus, the third processor 360 may reduce the replay speed of the exercise video guide so that the displayed reference posture corresponds to the recognized user's posture, that is, to make the reference posture displayed at a certain point in time identical to the user's posture. The replay speed may be adjusted in proportion to the user's movement speed, or may be adjusted step by step. For example, the third processor 360 may adjust the replay speed of the exercise video guide to any one of 0.9 times, 0.8 times, or 0.5 times the original speed so that the reference posture corresponds to the user's posture.

If the user's posture is determined to be a reference section behind the reference position, the third processor 360 may pause the exercise video guide until the displayed reference posture corresponds to the user's posture. In addition, if the user's posture is identical to the reference posture displayed in the exercise video guide, the third processor 360 may replay the exercise video guide again.

The third processor 360 determines the relation between the exercise speed of the user and the replay speed based on the recognized user's posture and the reference posture, but is not limited thereto. The third processor 360 may determine the relation between the exercise speed of the user and the replay speed based on the time when the movement of a certain user is performed and the replay time when the reference movement corresponding to the movement of the certain user is displayed.

For example, the third processor 360 may profile the user's movement from the postures of the recognized user, and separate the profiled movement of the user into sub set units. In addition, the third processor may compare the time spent by the user for performing the sub set with the replay time spent in replaying the sub set section of the exercise video guide.

The third processor may determine that the user's exercise speed and the replay speed are identical when a difference between the movement time and the replay time is within a reference time. The third processor may determine that the user's exercise speed is less than the replay speed when the movement time is a reference time or longer than the replay time. The third processor may determine that the user's exercise speed is greater than the replay speed when the movement time is a reference time or shorter than the replay time. Here, the reference time may refer to the time corresponding to the sub set section, and may be set by the user or administrator differently according to the exercise event. In addition, the previous methods of calculating the exercise speed may be applied to the method of calculating the user's exercise speed.

If the similarity rate between the user's posture and the reference posture corresponding to the user's posture for a certain period of time is lower than a reference value, the third processor 360 may end the display of the exercise video guide. The time may refer to a time corresponding with one set movement. However, embodiments are not limited thereto. A certain time may refer to be a time corresponding to two or three set movements.

If the third processor 360 does not receive the result regarding the movement of the user from the motion detection sensor 370 for a certain period of time, the third processor 360 may end the display of the exercise video guide. If the third processor 360 does not receive the result regarding the movement of the user from the motion detection sensor 370, the third processor 360 may determine that the similarity rate between the user's posture and the reference posture is '0'. If the motion detection sensor 370 does not detect the movement of the user, this may be a case where the user has left the exercise place.

If the user's posture instead of the reference posture lasts for a certain period of time, the third processor 360 may prevent the replay of unnecessary exercise video guides by ending the display of the exercise video guide. Therefore, power wastage of the exercise device or the mirror display 30 may be prevented.

The third processor 360 may provide the exercise video guide, together with information of the replay speed of the exercise video guide, and information of the similarity rate between the user's posture and the reference posture. The information may be provided in at least one of characters, graphs, texts, and sound.

Figure 17:
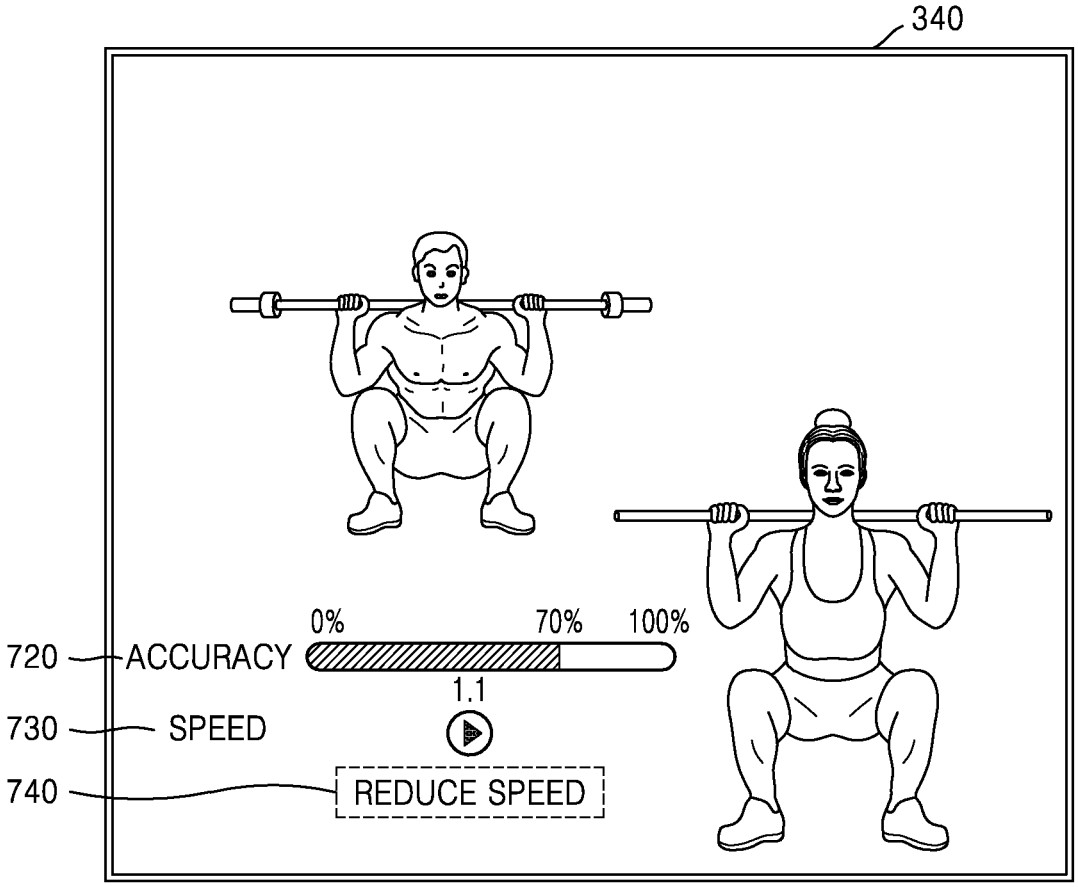
FIG. 17 is a reference diagram illustrating a method of providing an exercise video guide when a user's posture is ahead of a reference posture, according to an embodiment.
Figure 17:
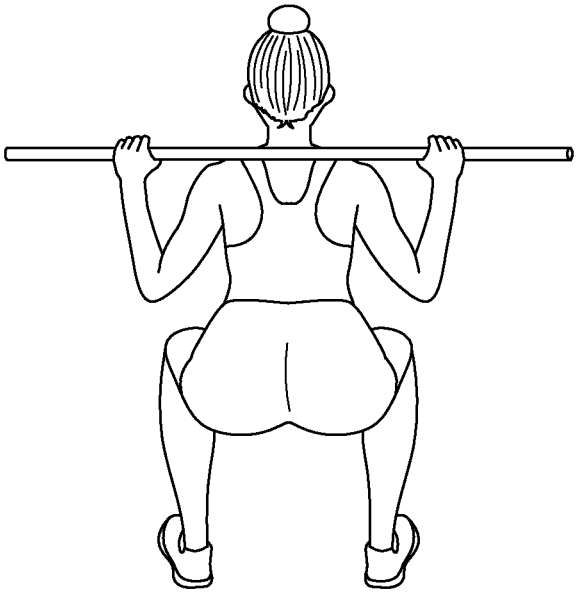
Figure 18:
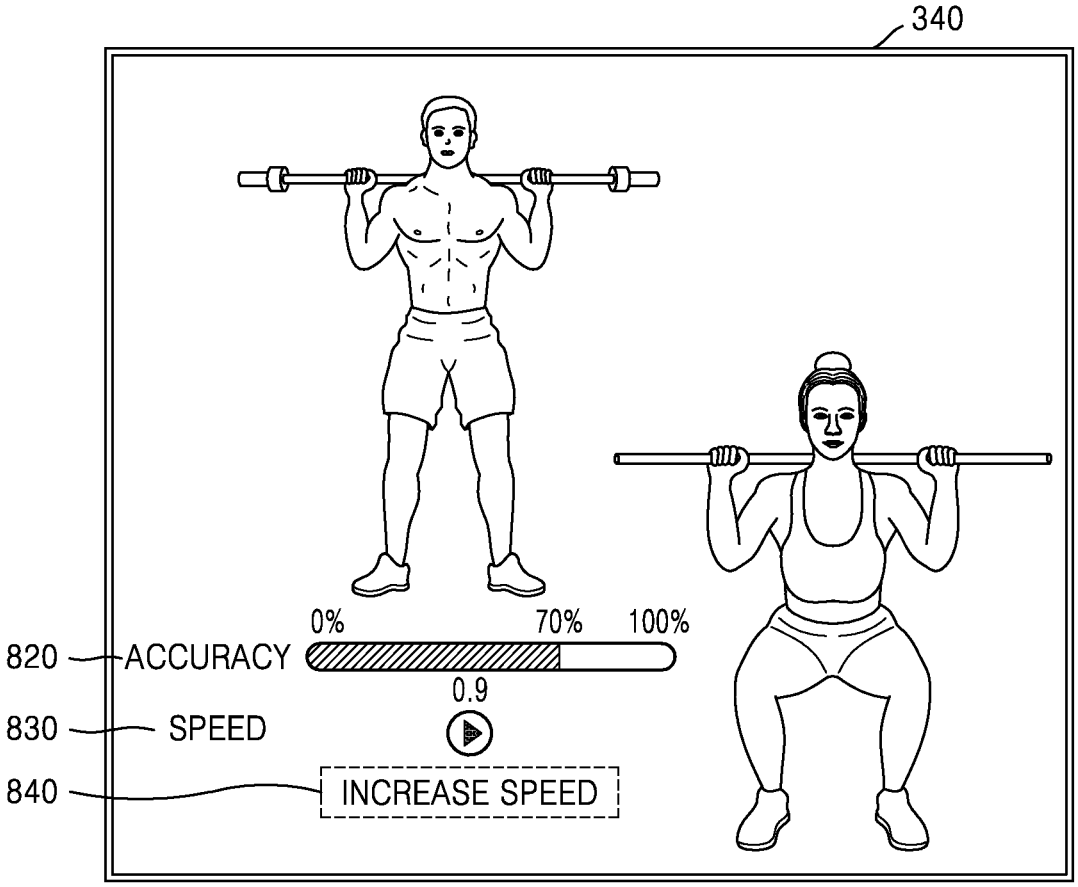
FIG. 18 is a reference diagram illustrating a method of providing an exercise video guide when a user's posture has fallen behind a reference posture, according to an embodiment.
Figure 18:
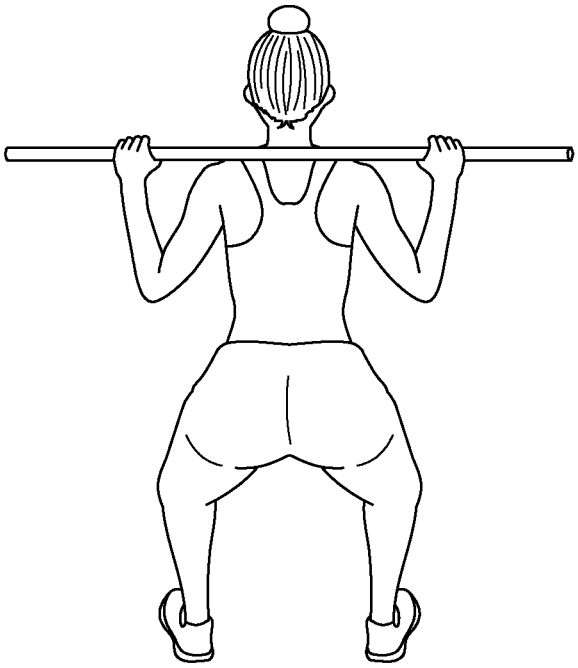
Figure 19:
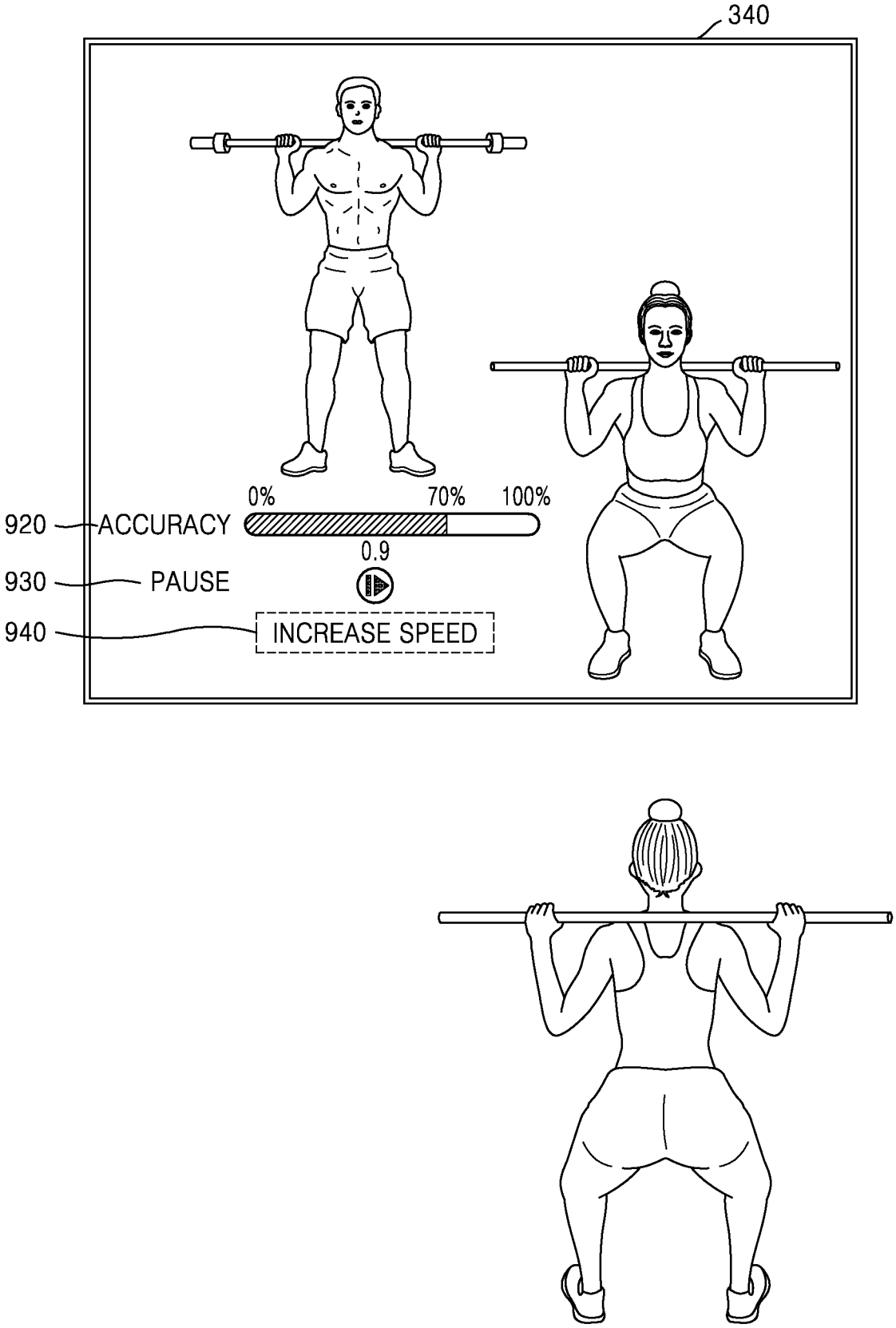
FIG. 19 is a reference diagram illustrating a method of providing an exercise video guide when a user's posture has fallen behind a reference posture, according to another embodiment.

FIGS. 17 to 19 are reference diagrams illustrating a method of providing the exercise video guide according to an embodiment.

As shown in FIG. 17, the third processor 360 may display an exercise video guide 710 on the display 340. The user may perform exercise while watching a reference posture displayed on the exercise video guide. The third processor 360 may compare the user's posture with a reference posture corresponding to the user's posture, calculate a similarity rate between the user's posture and the reference posture, and then display a result 720 thereof on the display 340. The user may confirm the accuracy of one's posture through the similarity rate.

In addition, if the user's posture is determined to be a reference section ahead of the reference position corresponding to the user's posture, the third processor 360 may determine that the user's exercise speed is greater than the replay speed of the exercise video guide. The third processor 360 may increase the replay speed of the exercise video guide so that the displayed reference posture corresponds to the user's posture.

In addition, as shown in FIG. 17, the third processor 360 may display a first indicator 730 which notifies that the replay speed of the exercise video guide has increased on the display 340. In addition, the third processor 360 may display a second indicator 740 on the display 340 to guide the user to decrease one's exercise speed.

If the user's posture is determined to be a reference section behind the reference position, the third processor 360 may determine that the user's exercise speed is less than the replay speed of the exercise video guide. In addition, the third processor 360 may decrease the replay speed of the exercise video guide so that the displayed reference posture corresponds to the user's posture.

In addition, as shown in FIG. 18, the third processor 360 may display a third indicator 830 which notifies that the replay speed of the exercise video guide has decreased on the display 340. In addition, the third processor 360 may display a fourth indicator 840 on the display 340 to guide the user to increase one's exercise speed.

Alternatively, as shown in FIG. 19, if the user's posture is determined to be falling a reference section behind the reference posture corresponding to the user's posture, the third processor 360 may pause the exercise video guide until the displayed reference posture corresponds to the user's posture. In addition, as shown in FIG. 19, the third processor 360 may display a fifth indicator 930 which notifies that the replay of the exercise video guide has paused on the display 340. When the user's posture reaches the reference posture shown in the display 340, the third processor 360 may restart the replay of the exercise video guide.

When the user's posture is determined to be falling a reference section behind the corresponding reference posture, the third processor 360 may pause the replay of the exercise video guide. However, embodiments are not limited thereto. If the user's posture is determined to be falling a reference section behind the reference posture, the third processor 360 may pause the replay of the exercise video guide at a sub set movement end point or a set movement end point.

The third processor 360 may store the user's exercise speed and refer to it when replaying the next exercise video guide. For example, when the user exercises faster than the replay speed every time the user exercises, the third processor 360 may increase the replay speed of the exercise video guide more than the preset replay speed.

The third processor 360 may provide an indicator indicating the similarity rate between the user's posture and the reference posture corresponding to the user's posture, but is not limited thereto. The third processor 360 may also provide information regarding the effect of the exercise of the user. The third processor 360 may display the effect of the exercise with a body type of an avatar, for example, a character that refers to the user.

Figure 20:
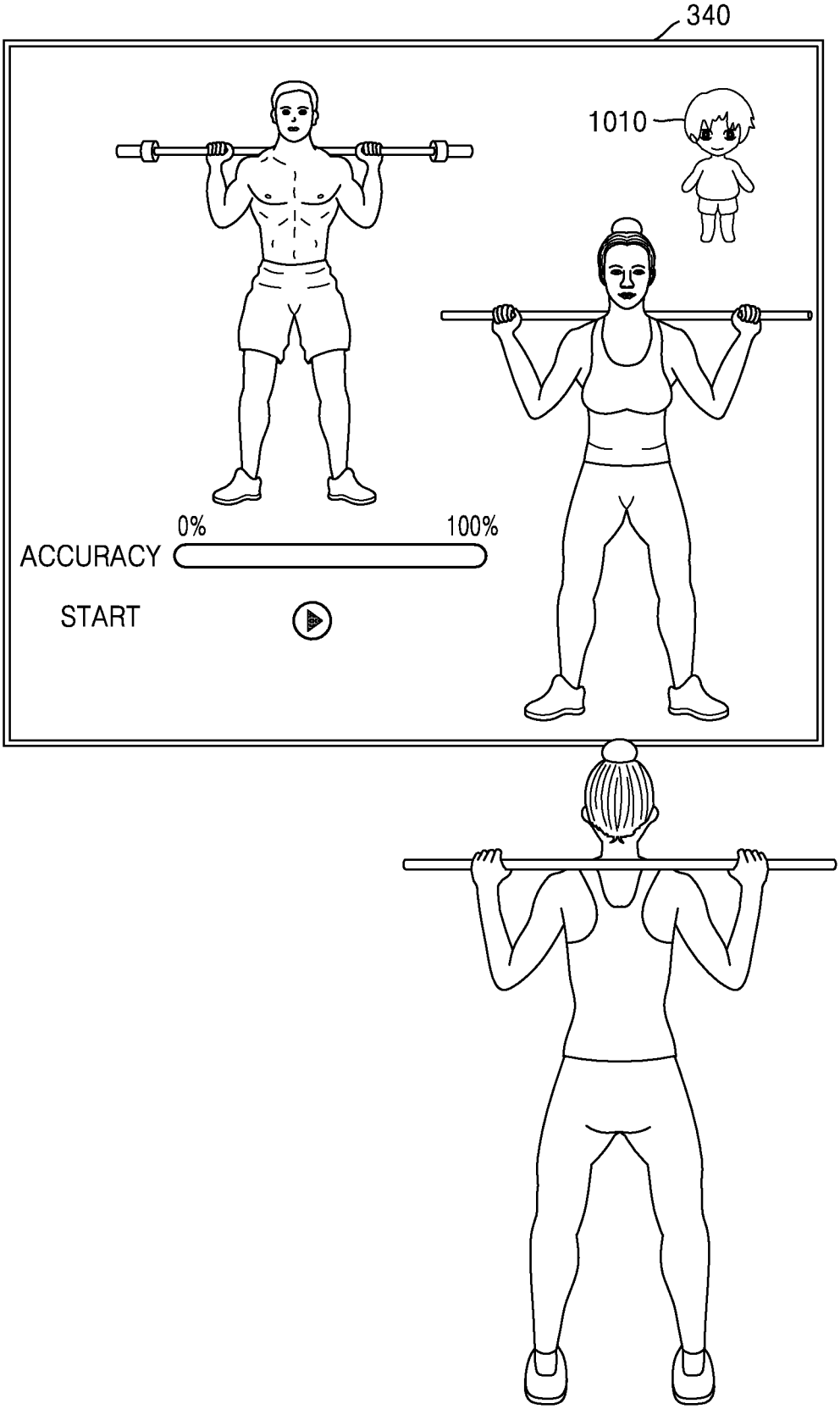
FIG. 20 is a reference diagram illustrating a method of displaying a character that refers to the user, according to an embodiment.
Figure 21:
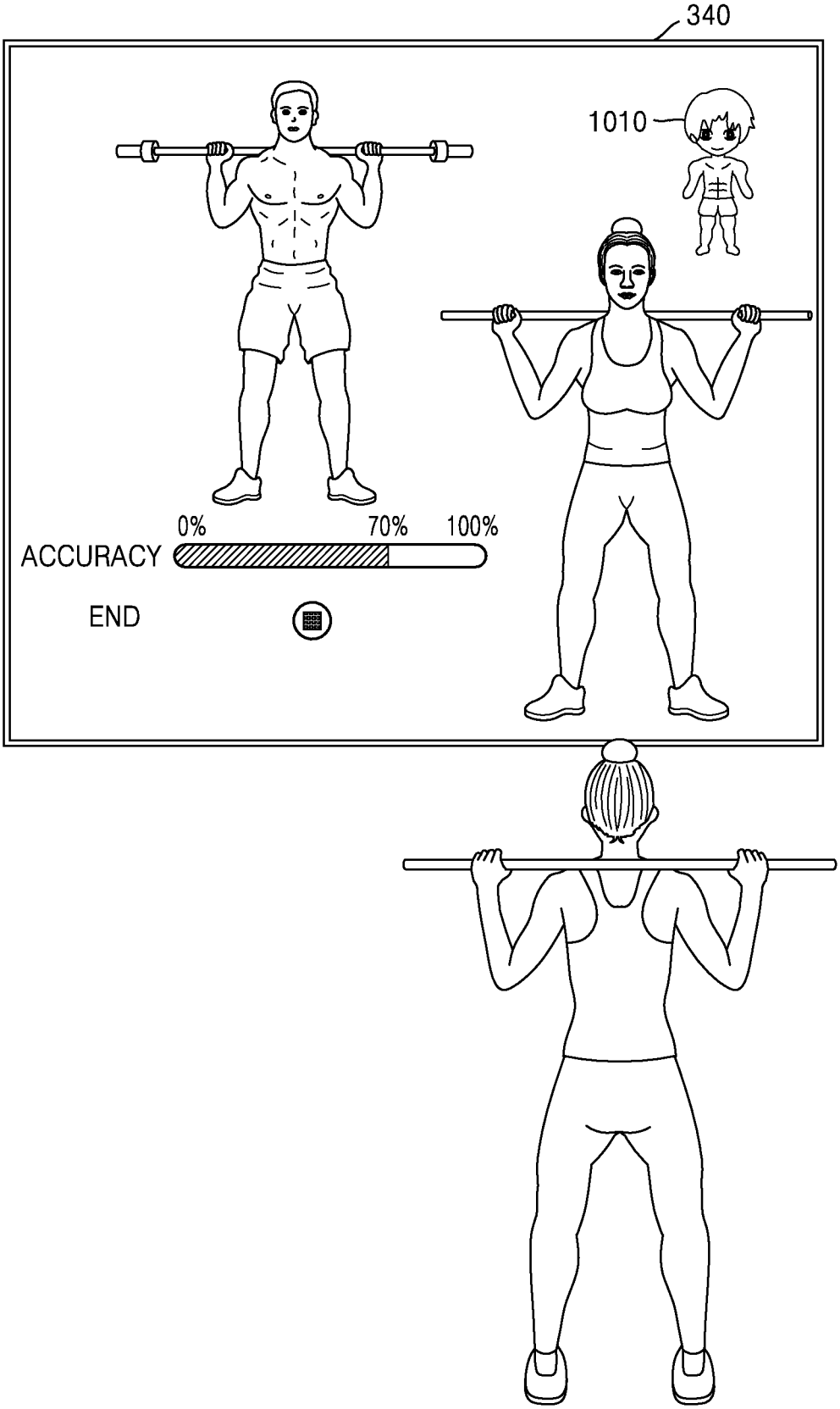
FIG. 21 is a reference diagram illustrating a method of showing an exercise effect with the character, according to an embodiment.

FIGS. 20 to 21 are reference diagrams illustrating a method of providing the effect of the exercise according to an embodiment. As shown in FIG. 20, the third processor 360 may display a character 1010 that refers to the user before replaying the exercise video guide.

In addition, the third processor 360 may compare the user's posture and the reference posture corresponding to the user's posture while displaying the exercise video guide, and may calculate the similarity rate between the user's posture and the reference posture. The third processor 360 may change the body type of the character based on the result of the calculated similarity rate, and the character 1010 of which the body type is changed may be displayed on the display 340. For example, the squat exercise has an effect of strengthening the lower body muscles and reducing fat. Therefore, as shown in FIG. 21, the third processor 360 may display a character 1010 of which the lower body muscles are strengthened and fat is reduced.

It has been explained that the mirror display 30 generates the exercise video guide, but embodiments are not limited thereto. The exercise video guide may be generated by the exercise device, or may be generated by a server communicable with the exercise device or the mirror display 30, and the exercise device or the mirror display 30 may display the generated exercise video guide. In addition, the exercise video guide may be generated in general electronic devices including the display, for example, a smartphone, a PC, a tablet PC, a notebook computer, a smart TV, a mobile phone, a PDA, a laptop, a media player, a digital broadcasting terminal, navigation, a wearable device, and other mobile and non-mobile computing devices.

A method according to an embodiment of the disclosure may be implemented in the form of program commands executable through various computer means and be recorded on a computer-readable recording medium. The computer-readable recording medium may include program commands, data files, data structures, and the like separately or in combinations. The program commands recorded on the computer-readable recording medium may be specially designed and configured for the disclosure or may be well-known to and be usable by one of ordinary skill in the art of computer software. Examples of the computer-readable recording medium include magnetic media such as hard disks, floppy disks, and magnetic tapes, optical media such as CD-ROMs and DVDs, magneto-optical media such as floptical disks, and hardware devices specially configured to store and perform program commands, such as read-only memory (ROM), random-access memory (RAM), and flash memory. Examples of the computer command include mechanical codes prepared by a compiler, and high-level language codes executable by a computer by using an interpreter.

Some embodiments of the disclosure may also be implemented in the form of a computer-readable recording medium including instructions executable by a computer, such as a program module executed by the computer. The computer-readable recording medium may be any available medium that may be accessed by a computer and includes both volatile and nonvolatile media, and removable and non-removable media. In addition, the computer-readable recording medium may include both a computer storage medium and a communication medium. The computer storage medium includes all of volatile and nonvolatile media, and removable and non-removable media implemented by any method or technology for storage of information such as computer-readable instructions, data structures, program modules, or other data. The communication medium typically includes computer-readable instructions, data structures, program modules, other data of a modulated data signal, such as a carrier wave, or other transmission mechanisms, and includes any information transfer media. In addition, some embodiments of the disclosure may be implemented as a computer program or computer program product including instructions executable by a computer such as computer programs executed by computers.

The machine-readable storage medium may be provided in the form of a non-transitory storage medium. The term "non-transitory' merely means that the storage medium is tangible and does not include a signal (e.g., an electromagnetic wave), and does not distinguish whether data is stored semi-permanently or temporarily on the storage medium. For example, a "non-transitory storage medium" may include a buffer where the data is temporarily stored.

According to an embodiment, the method according to various embodiments disclosed herein may be included in a computer program product and provided. The computer program products are products that can be traded between sellers and purchasers. The computer program product may be distributed in a form of a machine-readable storage medium (e.g., compact disk read only memory (CD-ROM)), or may be distributed online (e.g., downloaded or uploaded) through an application store or directly between two user devices (e.g., smart phones). In the case of an online distribution, at least some of the computer program products (e.g., downloadable app) may be at least temporarily stored or generated in a device-readable storage medium such a manufacturer's server, a server of an application store, or a memory of a relay server.

An exercise video guide according to an embodiment may adjust the times of set movements.

The exercise video guide according to an embodiment may provide set movements, which are repetition movements, without disconnection of the video.

Because the exercise video guide according to an embodiment may be adjusted according to the user's exercise speed, the exercise video guide may be provided more usefully to the user.

It should be understood that embodiments described herein should be considered in a descriptive sense only and not for purposes of limitation. Descriptions of features or aspects within each embodiment should typically be considered as available for other similar features or aspects in other embodiments. While one or more embodiments have been described with reference to the figures, it will be understood by those of ordinary skill in the art that various changes in form and details may be made therein without departing from the spirit and scope of the disclosure as defined by the following claims.

What is claimed is:

1. A method of providing an exercise video guide comprising a set movement as a repetition movement, the method comprising:

receiving, from a user interface or an external device, a command to generate the exercise video guide comprising n set movements as a number of times of set movements, the number being an integer greater than or equal to 2;

reading out, by one or more processors, an original video comprising at least one set movement stored in a memory;

generating, by the one or more processors, the exercise video guide comprising n set movements, by creating a continuous movement video without a movement discontinuity based on a reverse-replay of a section of the stored original video; and displaying, by the one or more processors, the generated exercise video guide on a display, wherein the original video comprises: a preparation section showing a preparation movement; a first section showing a first movement; a second section showing a second movement opposite to the first movement; and a finishing section showing a finishing movement, wherein the preparation movement is different from the finishing movement, wherein the generating of the exercise video guide comprises:

replaying the preparation section only for one time;

repeatedly executing at least one of a first step of reverse-replaying the first section after replaying the first section and a second step of replaying the second section after reverse-replaying the second section correspondingly to the number of times of set movements, a sum of repetition times of the first step and the second step being less than the number of times of set movements; and replaying the finishing section only for one time, and, wherein the repeatedly executed at least one of the first step and the second step are displayed after the replayed preparation section is displayed and before the replayed finishing section is displayed.

2. The method of claim 1, wherein the sum of repetition times of the first step and the second step is one time less than the number of times of set movements.

3. The method of claim 1, further comprising a third step of sequentially replaying the first section and the second section.

4. The method of claim 1, wherein the display is a mirror display.

5. A device for providing an exercise video guide comprising a set movement as a repetition movement, the device comprising:

a memory storing an original video comprising one set movement;

a display; and one or more processors configured to:

receive, from a user interface or an external device, a command to generate the exercise video guide comprising n set movements as a number of times of set movements, the number being an integer greater than or equal to 2, read out the original video from the memory, and generate the exercise video guide comprising n set movements by creating a continuous movement video without a movement discontinuity based on a reverse-replay of a section of the stored original video, and display the generated exercise video guide on the display, wherein the original video comprises: a preparation section showing a preparation movement; a first section showing a first movement; a second section showing a second movement opposite to the first movement; and a finishing section showing a finishing movement, wherein the preparation movement is different from the finishing movement, and wherein the one or more processors are further configured to generate the exercise video guide by:

replaying the preparation section only for one time;

repeatedly executing at least one of a first step of reverse-replaying the first section after replaying the first section and a second step of replaying the second section after reverse-replaying the second section correspondingly to the number of times of set movements, a sum of repetition times of the first step and the second step being less than the number of times of set movements; and replaying the finishing section only for one time; and wherein the repeatedly executed at least one of the first step and the second step are displayed after the replayed preparation section is displayed and before the replayed finishing section is displayed.

6. The device of claim 5, wherein the one or more processors are further configured to repeatedly execute the at least one of the first step and the second step less than the number of times of set movements.

7. A computer-readable recording medium having recorded thereon a program for executing, on a computer, the method of claim 1.

8. The method of claim 1, further comprising:

detecting a user's posture through a sensor;

continuing to display the exercise video guide while adjusting a playback speed of the exercise video guide in proportion to a movement speed of the user, based on a similarity rate between the detected user's posture and a reference posture in the exercise video guide being greater than or equal to a reference value; and stopping the display of the exercise video guide, based on the similarity rate being less than the reference value.

9. The device of claim 5, further comprising:

a sensor configured to detect a user's posture, wherein the one or more processors are further configured to continue to display the exercise video guide while adjusting a playback speed of the exercise video guide in proportion to a movement speed of the user, based on a similarity rate between the detected user's posture and a reference posture in the exercise video guide being greater than or equal to a reference value and stop the display of the exercise video guide, based on the similarity rate being less than the reference value.

* * * * *